US008774674B2

(12) United States Patent
Tokunaga et al.

(10) Patent No.: US 8,774,674 B2
(45) Date of Patent: Jul. 8, 2014

(54) IMAGE FORMING APPARATUS AND TRANSPORT GUIDING DEVICE HAVING A SMOOTHLY OPERATING DOOR

(75) Inventors: Masaaki Tokunaga, Kanagawa (JP); Masakazu Shirai, Kanagawa (JP); Masatoshi Yamada, Kanagawa (JP); Mabumi Kashihara, Kanagawa (JP); Hiroyuki Koide, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 233 days.

(21) Appl. No.: 13/414,869

(22) Filed: Mar. 8, 2012

(65) Prior Publication Data

US 2013/0077995 A1 Mar. 28, 2013

(30) Foreign Application Priority Data

Sep. 22, 2011 (JP) ..... 2011-208083

(51) Int. Cl.
*G03G 15/00* (2006.01)
*G03G 15/16* (2006.01)
*G03G 21/16* (2006.01)

(52) U.S. Cl.
CPC ..... *G03G 21/1623* (2013.01); *G03G 21/1638* (2013.01)
USPC ..... 399/110; 399/121; 399/124

(58) Field of Classification Search
CPC ..... G03G 21/1623; G03G 21/1633; G03G 21/1638; G03G 2215/00544
USPC ..... 399/107, 110, 121, 124
See application file for complete search history.

(56) References Cited

U.S. PATENT DOCUMENTS

| | | | | |
|---|---|---|---|---|
| 7,639,965 | B2 * | 12/2009 | Palumbo et al. | 399/107 |
| 8,526,848 | B2 * | 9/2013 | Nishiuwatoko et al. | 399/110 |
| 2011/0110684 | A1 | 5/2011 | Sato et al. | |
| 2011/0110685 | A1 | 5/2011 | Sato et al. | |

FOREIGN PATENT DOCUMENTS

| | | | |
|---|---|---|---|
| JP | 2011-102860 | A | 5/2011 |
| JP | 2011-102861 | A | 5/2011 |

* cited by examiner

*Primary Examiner* — William J Royer
(74) *Attorney, Agent, or Firm* — Sughrue Mion, PLLC

(57) ABSTRACT

An image forming apparatus includes a body frame, a transport unit, an image carrier, a transfer device, a fixing device, a guide member assembly, a door, and a positioning member. The guide member assembly includes a guide member, a positioned portion, and a support member. The support member supports the guide member and has a side wall that extends in such a direction as to intersect a line drawn in the width direction and that has a hole through which a support shaft is inserted with some play being present. The guide member assembly is supported by the door with some play being present between the guide member assembly and a base plate and is urged by an urging member. The hole is a long hole having a major axis extending in an opening direction of the door away from a center line of rotation of the door.

8 Claims, 22 Drawing Sheets

IMAGE FORMING APPARATUS AND TRANSPORT GUIDING DEVICE HAVING A SMOOTHLY OPERATING DOOR

CROSS-REFERENCE TO RELATED APPLICATIONS

This application is based on and claims priority under 35 USC 119 from Japanese Patent Application No. 2011-208083 filed Sep. 22, 2011.

BACKGROUND

Technical Field

The present invention relates to an image forming apparatus and a transport guiding device.

SUMMARY

According to an aspect of the invention, an image forming apparatus includes a body frame, a transport unit that transports a recording medium along a transport path in the body frame, an image carrier on which a toner image is formed, the image carrier carrying the toner image and transporting the toner image to a transfer position through which the recording medium is to pass, a transfer device that faces the image carrier at the transfer position, the transfer device nipping a recording medium passing through the transfer position together with the image carrier to transfer the toner image formed on the image carrier to the recording medium, a fixing device that is disposed on a side that is further downstream than the transfer position in a direction in which the recording medium is transported, the fixing device fixing the toner image onto the recording medium to which the toner image has been transferred at the transfer position, a guide member assembly including a guide member and a positioned portion, the guide member being positioned between the transfer device and the fixing device, the guide member guiding the recording medium to which the toner image has been transferred by the transfer device to the fixing device, the positioned portion being positioned at a position that is outside of a region through which the recording medium is to pass, a door that includes a base plate and supports the guide member assembly on an inner side of the base plate, the door opening and closing with respect to the body frame by rotating around a center line of rotation thereof that extends substantially in a width direction that crosses a direction in which the recording medium passes, and a positioning member that is supported by the body frame and that positions the guide member by being pressed by the positioned portion. The door further includes a support shaft and an urging member, the support shaft being fixed to the base plate and extending substantially parallel to the center line of rotation with a gap between the support shaft and the inner side of the base plate, the urging member urging the guide member assembly in such a direction that the guide member assembly is separated from the base plate. The guide member assembly includes a support member supporting the guide member and having a side wall that extends in such a direction as to intersect a line drawn in the width direction and that has a hole through which the support shaft is inserted with some play being present, and the guide member assembly is supported by the door with some play being present between the guide member assembly and the base plate and is urged by the urging member. The hole is a long hole having a major axis extending in an opening direction of the door away from the center line of rotation of the door.

BRIEF DESCRIPTION OF THE DRAWINGS

Exemplary embodiment(s) of the present invention will be described in detail based on the following figures, wherein.

DETAILED DESCRIPTION

Hereinbelow, an exemplary embodiment of the present invention will be described.

Figure 1:
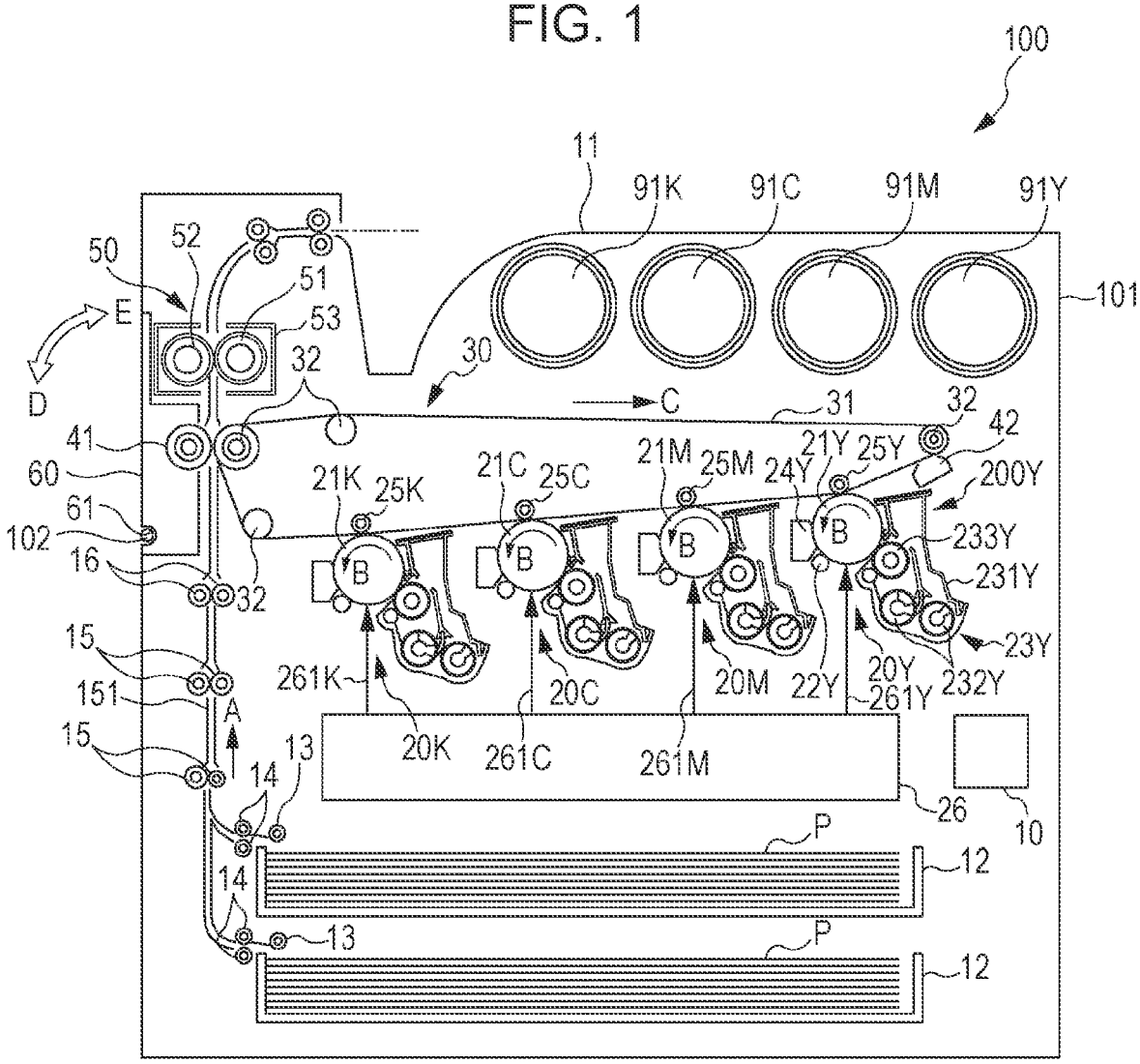
FIG. 1 is a schematic diagram of a printer, which is an example of an image forming apparatus.

FIG. 1 is a schematic diagram of a printer 100, which is an example of an image forming apparatus.

The printer 100 includes a body frame 101 as a casing, and a controller 10 is contained inside the body frame 101. The controller 10 receives image data from an external device outside the printer 100, such as a scanner that reads a document image and generates image data or a computer that performs image processing. The controller 10 converts image data input from the external device to image data that is used for exposure light modulation by an exposure device 26, which will be described below.

The printer 100 includes a paper output tray 11, to which sheets having images formed thereon are output, on an upper portion of the body frame 101. The printer 100 also includes two paper feed trays 12 in a lower portion thereof. These paper feed trays 12 contain stacked sheets P, which have not yet been subjected to image forming. These paper feed trays 12 are allowed to be drawn for replenishment of sheets P.

In image forming, sheets P are fed from one of the paper feed trays 12 by a pickup roller 13 and separated into individual sheets by separation rollers 14. Then, one of the sheets P is transported upward in an arrow A direction along a transport path 151 in the body frame 101 by transport rollers 15 and transported further upward after stand-by rollers 16 adjust subsequent transport timing. Transport of the sheet P beyond the stand-by rollers 16 will be described below.

Four image forming engines 20Y, 20M, 20C, and 20K are disposed in substantially a vertical middle portion of the printer 100. These image forming engines 20Y, 20M, 20C, and 20K form toner images using corresponding color toners of yellow (Y), magenta (M), cyan (C), and black (K). Since these four image forming engines 20Y, 20M, 20C, and 20K have the same structure, the image forming engine 20Y is taken as an example for describing the structure of the image forming engines 20Y, 20M, 20C, and 20K.

The image forming engine 20Y includes a photoconductor 21Y, which rotates in an arrow B direction illustrated in FIG. 1. A charging device 22Y, a developing device 23Y, and a cleaner 24Y are arranged around the photoconductor 21Y. The photoconductor 21Y, the charging device 22Y, the developing device 23Y, and the cleaner 24Y form an image forming unit 200Y, which is dismountably mounted on the body frame 101 by sliding in a rotation axis direction that is perpendicular to the plane of FIG. 1.

A transfer device 25Y is disposed at such a position as to sandwich an intermediate transfer belt 31, which will be described below, together with the photoconductor 21Y.

The exposure device 26 is disposed below the four image forming engines 20Y, 20M, 20C, and 20K. The exposure device 26 receives image data that is generated by the controller 10 and that is to be subjected to exposure light modulation by the exposure device 26. The exposure device 26 emits exposure light beams 261Y, 261M, 261C, and 261K, which are light beams modulated on the basis of input image data and correspond to the image forming engines 20Y, 20M, 20C, and 20K. Photoconductors 21Y, 21M, 21C, and 21K included in the respective image forming engines 20Y, 20M, 20C, and 20K are irradiated with the corresponding exposure light beams 261Y, 261M, 261C, and 261K.

Now, the description of the image forming engine 20Y will be continued.

The photoconductor 21Y has a roll shape. The photoconductor 21Y holds charges by being charged and discharges the charges by being exposed to light to thus hold an electrostatic latent image on the surface thereof.

The charging device 22Y charges the surface of the photoconductor 21Y to a certain charging potential.

The exposure device 26 emits the exposure light beam 261Y that is modulated on the basis of the input image data. The photoconductor 21Y is charged by the charging device 22Y and then irradiated with the exposure light beam 261Y by the exposure device 26. Consequently, an electrostatic latent image is formed on the surface of the photoconductor 21Y.

After the photoconductor 21Y is irradiated with the exposure light beam 261Y and an electrostatic latent image is formed on the surface of the photoconductor 21Y, the electrostatic latent image is developed by the developing device 23Y. Thus, a toner image is formed on the surface of the photoconductor 21Y (a yellow (Y) toner image in the case of the image forming engine 20Y).

The developing device 23Y includes two augers 232Y and a developing roller 233Y in a casing 231Y that contains a developer containing a toner and a carrier. The augers 232Y agitate the developer and the developing roller 233Y conveys the developer to the position at which the developer faces the photoconductor 21Y. When the electrostatic latent image formed on the photoconductor 21Y is developed, a bias voltage is applied to the developing roller 233Y and the toner contained in the developer adheres to the photoconductor 21Y with the effect of the bias voltage in accordance with the electrostatic latent image formed on the photoconductor 21Y. Thus, a toner image is formed.

The toner image formed on the surface of the photoconductor 21Y by being developed by the developing device 23Y is transferred to the intermediate transfer belt 31 by an operation of the transfer device 25Y.

Part of the toner remaining on the surface of the photoconductor 21Y after the transfer is removed from the surface of the photoconductor 21Y by the cleaner 24Y.

The intermediate transfer belt 31 is an endless belt that is wound around multiple rollers 32 and that rotates in an arrow C direction. The intermediate transfer belt 31, the multiple rollers 32, and transfer devices 25Y, 25M, 25C, and 25K included in the respective image forming engines 20Y, 20M, 20C, and 20K, form an intermediate transfer unit 30, which is dismountably mounted on the body frame 101 by sliding in the rotation axis direction that is perpendicular to the plane of FIG. 1. A door 60 that is illustrated as being on the left side of FIG. 1 is opened to mount or dismount the intermediate transfer unit 30 on or from the body frame 101, and the door 60 is kept open during the mounting or dismounting operation. The door 60 is opened to mount the intermediate transfer unit 30 on the printer 100, and the door 60 is closed after the intermediate transfer unit 30 is mounted on the printer 100. The door 60 will be further described in detail below.

Toner images formed with color toners of the corresponding image forming engines 20Y, 20M, 20C, and 20K are transferred onto the intermediate transfer belt 31 one by one in a stacking manner, and transported to a second transfer position at which a second transfer roller 41 is disposed. The second transfer roller 41 is positioned at the second transfer position so as to face the intermediate transfer belt 31 and nips a sheet that is passing through the second transfer position together with the intermediate transfer belt 31 to transfer a toner image on the intermediate transfer belt 31 to the sheet. More specifically, at the timing when a toner image transferred to the surface of the intermediate transfer belt 31 is transported to the second transfer position, a sheet that has been transported to the stand-by rollers 16 is further transported to the second transfer position. Then, by operating the second transfer roller 41, the toner image on the intermediate transfer belt 31 is transferred to the transported sheet. The sheet subjected to the toner image transfer is further transported to a fixing device 50. The fixing device 50 has a structure in which a casing 53 houses a heating roller 51 and a compression roller 52. The sheet subjected to the toner image transfer is heated and compressed while passing through and being nipped by the heating roller 51 and the compression roller 52 of the fixing device 50. Thus, the toner image on the sheet is fixed to the sheet and an image based on the fixed toner image is formed on the sheet. The sheet having the image thereon is further transported and output onto the paper output tray 11.

The intermediate transfer belt 31 from which the toner image has been transferred to the sheet by the second transfer roller 41 is further rotated, and thus part of the toner remaining on the surface is removed from the intermediate transfer belt 31 by a cleaner 42.

The printer 100 also includes toner containers 91Y, 91M, 91C, and 91K that contain corresponding color toners and that are mounted above the intermediate transfer belt 31. Developing devices 23Y, 23M, 23C, and 23K of the respective image forming engines 20Y, 20M, 20C, and 20K are refilled with the corresponding color toners contained in these toner containers 91Y, 91M, 91C, and 91K according to the amount of toner consumed by the developing devices 23Y, 23M, 23C, and 23K.

The intermediate transfer belt 31 of the printer 100 holds toner images that are formed thereon, and transports the toner images to the second transfer position through which a recording medium passes. The intermediate transfer belt 31 is an example of an image carrier in the present invention. In addition, the second transfer position is an example of a transfer position in the present invention, and the second transfer roller 41 is an example of a transfer roller in the present invention.

The door 60 supports a second transfer unit 40 that includes the second transfer roller 41 (illustrated in FIG. 4, for example, and will be described below). The door 60 is opened and closed in arrow D-E directions by rotating around a pin 102 that is fixed to the body frame 101 and fitted into a cutout portion 61 at a lower end portion of the door 60. When the door 60 is closed by rotating in the arrow E direction, the second transfer roller 41 is pressed against the intermediate transfer belt 31 by a predetermined force.

Figure 2:
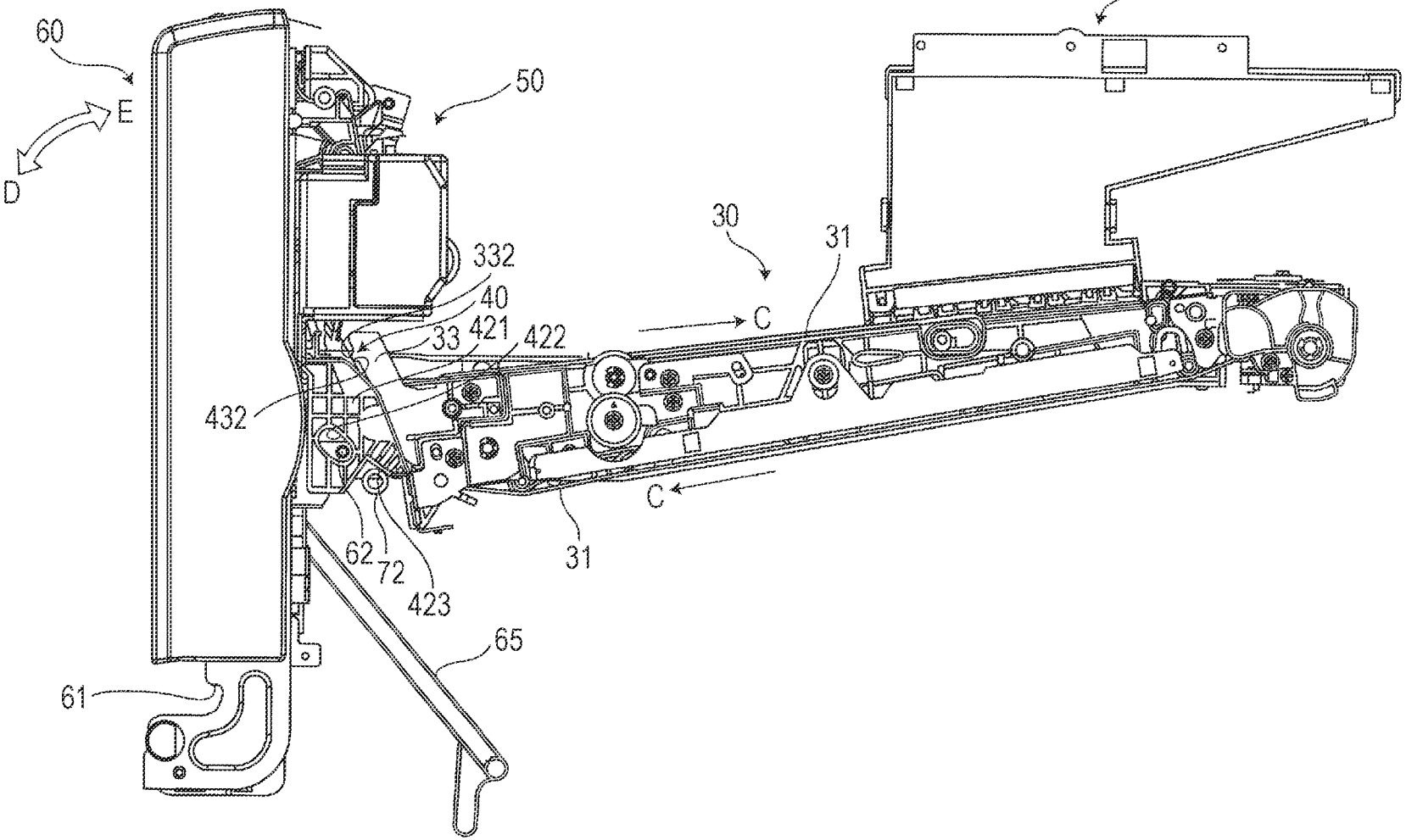
FIG. 2 is a partial assembly drawing that illustrates a door on a left side surface of the printer illustrated in FIG. 1 and an intermediate transfer unit mounted in a body frame, which are seen in the same direction as that of FIG. 1.

FIG. 2 is a partial assembly drawing that illustrates the door 60 on the left side surface of the printer 100 illustrated in FIG. 1 and the intermediate transfer unit 30 mounted in the body frame 101, which are seen in the same direction as that of FIG. 1.

Figure 3:
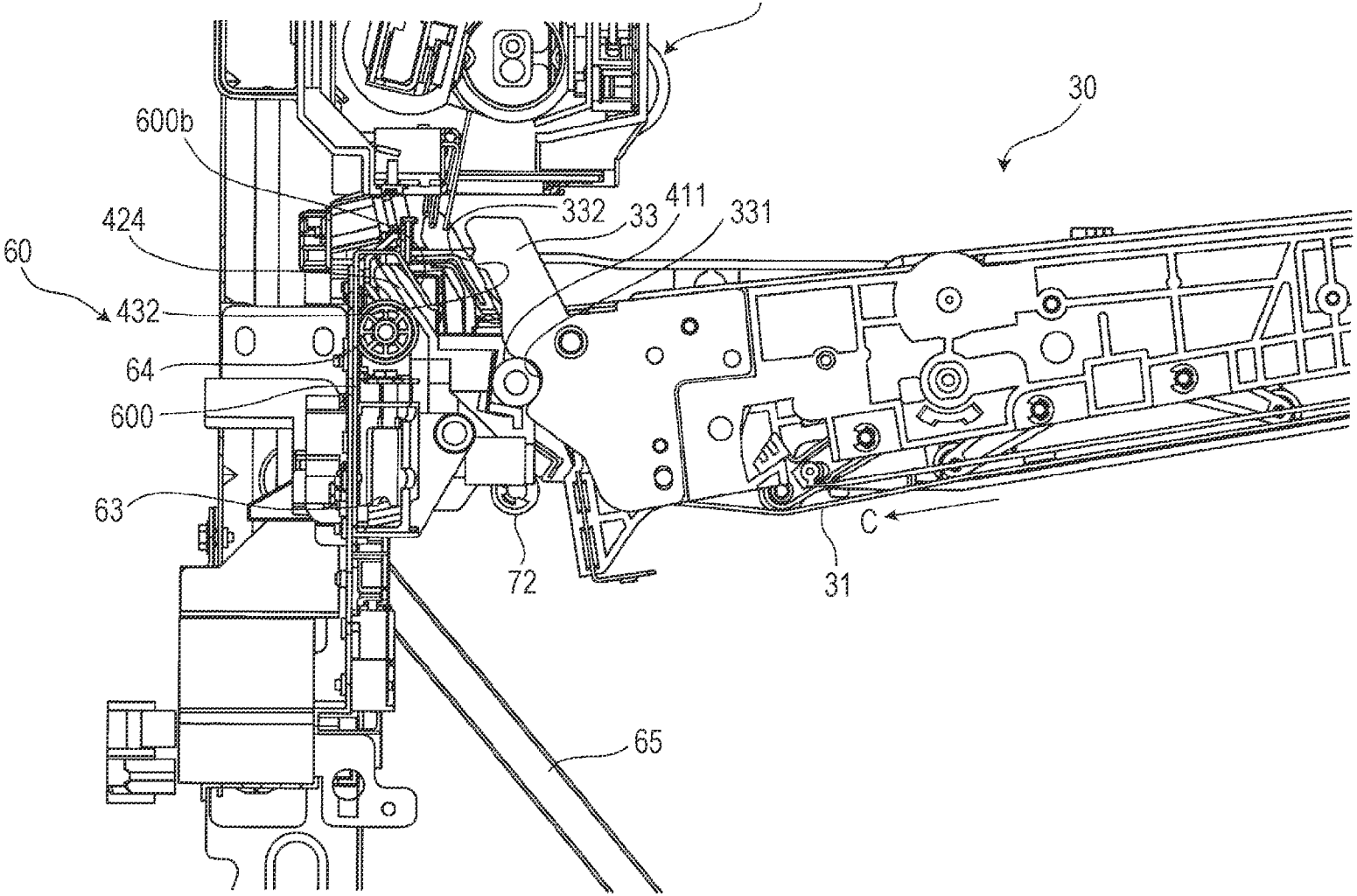
FIG. 3 is an enlarged sectional view of a portion at which the door and the intermediate transfer unit are in contact with each other.

FIG. 3 is an enlarged sectional view of a portion at which the door 60 and the intermediate transfer unit 30 are in contact with each other.

As described with reference to FIG. 1, the intermediate transfer unit 30 includes the intermediate transfer belt 31 that rotates in the arrow C direction, and is mounted in the body frame 101 (see FIG. 1) by sliding in the direction that is perpendicular to the pages of FIGS. 1 and 2. FIG. 2 illustrates a power supply unit 71 disposed above the intermediate transfer unit 30. The power supply unit 71 supplies power to components including the transfer devices 25Y, 25M, 25C, and 25K (see FIG. 1) that form the intermediate transfer unit 30. The intermediate transfer unit 30 includes a pair of positioning plates 33 on the door 60 side. The positioning plates 33 are pressed by the second transfer unit 40 (see FIG. 4), which is supported by the door 60, to position the second transfer roller 41 (see FIG. 1) of the second transfer unit 40. The pair of positioning plates 33 are arranged on widthwise (a direction that is perpendicular to the pages of FIGS. 1 and 2) both sides of the intermediate transfer belt 31 so as to sandwich the intermediate transfer belt 31. FIG. 2 illustrates a side wall 421 of the second transfer unit 40 illustrated in FIG. 4 seen in an arrow F direction of FIG. 4.

As described with reference to FIG. 1, the door 60 has the cutout portion 61 at a lower end portion thereof, and is opened and closed in the arrow D-E directions by rotating around the pin 102 (see FIG. 1) that is fixed to the body frame 101 and fitted into the cutout portion 61. A support bar 65 that stops the door 60 from being opened excessively is attached to the door 60.

Although the structure of the second transfer unit 40 will be described in detail below, FIG. 2 illustrates the side wall 421 of a support member 42 (see FIG. 4) included in the second transfer unit 40. The side wall 421 has a long hole 422, and a long-hole restriction shaft 62 is disposed in the long hole 422 with some play being present. The long-hole restriction shaft 62 is an example of a support shaft in the present invention.

Receiving members 72 that are supported by the body frame 101 (see FIG. 1) are disposed under the second transfer unit 40. The receiving members 72 are pressed by fulcrum portions 423 that are positioned at lower end portions of the side walls 421 of the support member 42 of the second transfer unit 40.

As illustrated in FIG. 3, each positioning plate 33 of the intermediate transfer unit 30 includes a recessed portion 331 and a projecting portion 332. The recessed portions 331 are pressed by bearing members 411 that are coaxial with a rotation shaft 412 of the second transfer roller 41 (see FIG. 4). The projecting portions 332 are pressed by positioned portions 432 (see FIG. 4) of a guide member 43 that guides a sheet that is being transported. The positioning plates 33 are examples of a positioning member in the present invention. The door 60 also includes spring members 63 and pressing members 64 that are urged upward by the spring members 63. When the door 60 is rotated in the arrow E direction of FIGS. 1 and 2 from the state where the door 60 is opened with respect to the body frame 101 (open state) to the closed state, the fulcrum portions 423 positioned at the lower end portions of the side walls 421 (see FIGS. 2 and 4) are pressed against the receiving members 72, and the bearing members 411 of the second transfer roller 41 are pressed against the recessed portions 331 of the positioning plate 33. Thereafter, the pressing members 64 press against pressing-member receiving portions 424 of the support member 42 and then are pressed downward by the reaction force of the pressing-member receiving portions 424 to compress the spring members 63. In this manner, the fulcrum portions 423 positioned at the lower end portions of the side walls 421 serve as fulcrums and the pressing-member receiving portions 424 serve as points of effort, so that the bearing members 411 of the second transfer roller 41 are firmly pressed against the recessed portions 331 of the positioning plates 33 with a predetermined force. Thus, by closing the door 60 with a small operating force in this manner, the bearing members 411 of the second transfer roller 41 are pressed against the recessed portions 331 of the positioning plates 33 with a predetermined force by the principle of leverage.

The fixing device 50 supported by the body frame 101 (see FIG. 1) is disposed above the second transfer unit 40 that is attached to the door 60.

Figure 4:
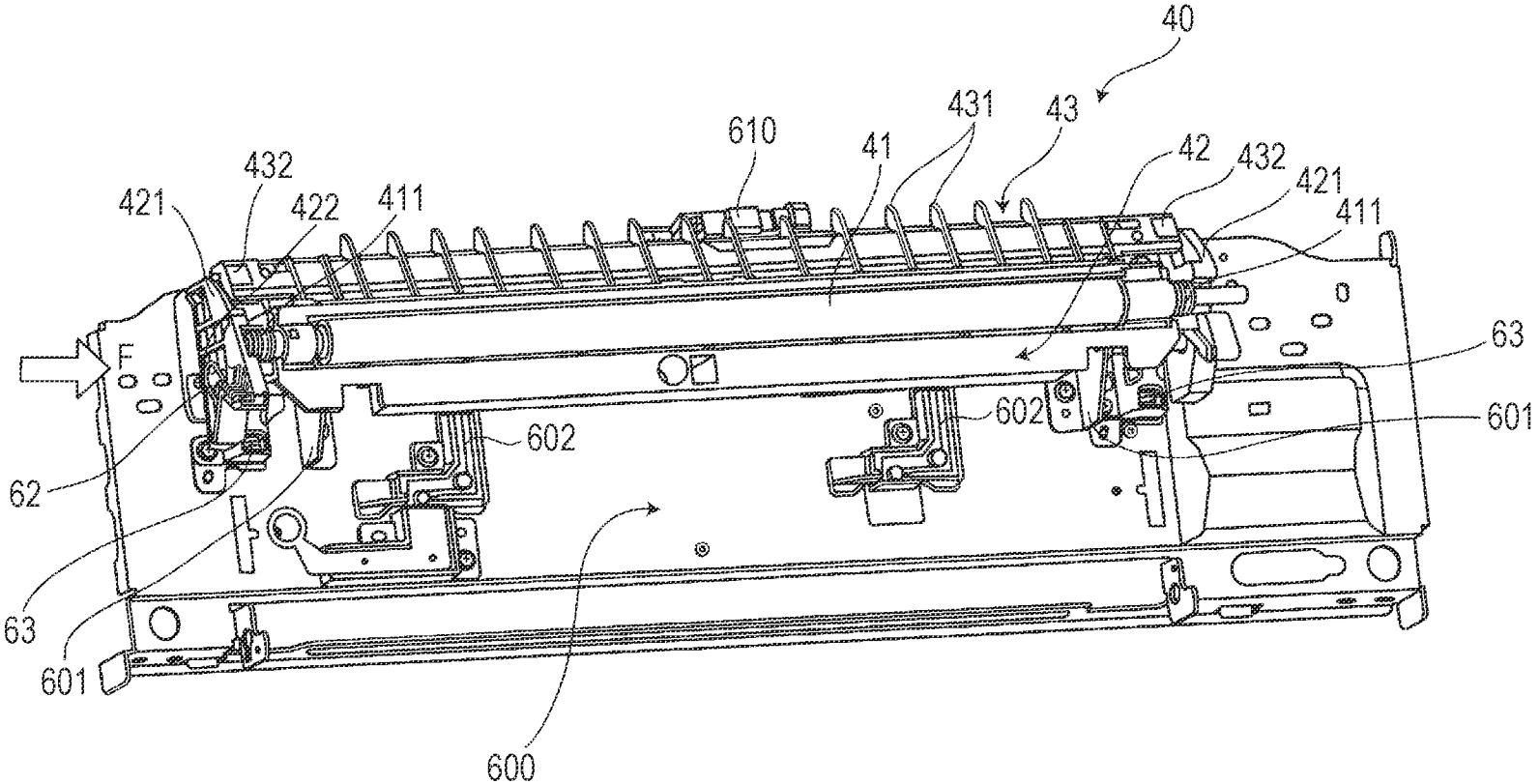
FIG. 4 is a perspective view of a second transfer unit supported by a base plate of the door and seen from the intermediate transfer unit side.

FIG. 4 is a perspective view of the second transfer unit 40 supported by a base plate 600 of the door 60 and seen from the intermediate transfer unit 30 side (see FIGS. 1 and 2). The second transfer unit 40 is an assembly of multiple components.

Figure 5:
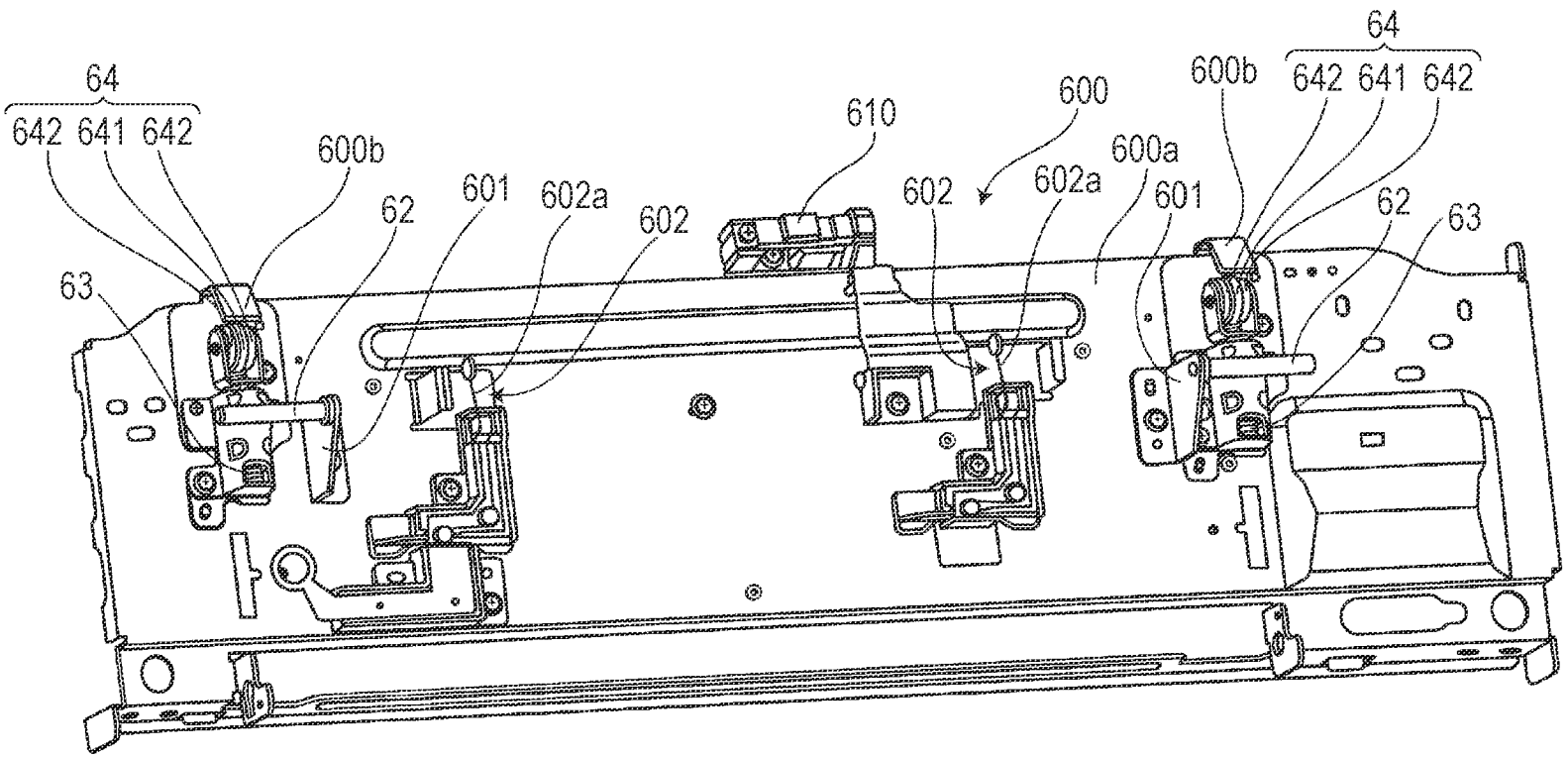
FIG. 5 is a perspective view of the base plate of the door.

FIG. 5 is a perspective view of the base plate 600 of the door 60. The base plate 600 is disposed on the inner side of the door 60. FIG. 5 illustrates a surface of the base plate 600 on which the second transfer unit 40 (see FIG. 4) is supported, i.e., a surface facing the intermediate transfer unit 30 (see FIGS. 1 and 2).

Figure 6:
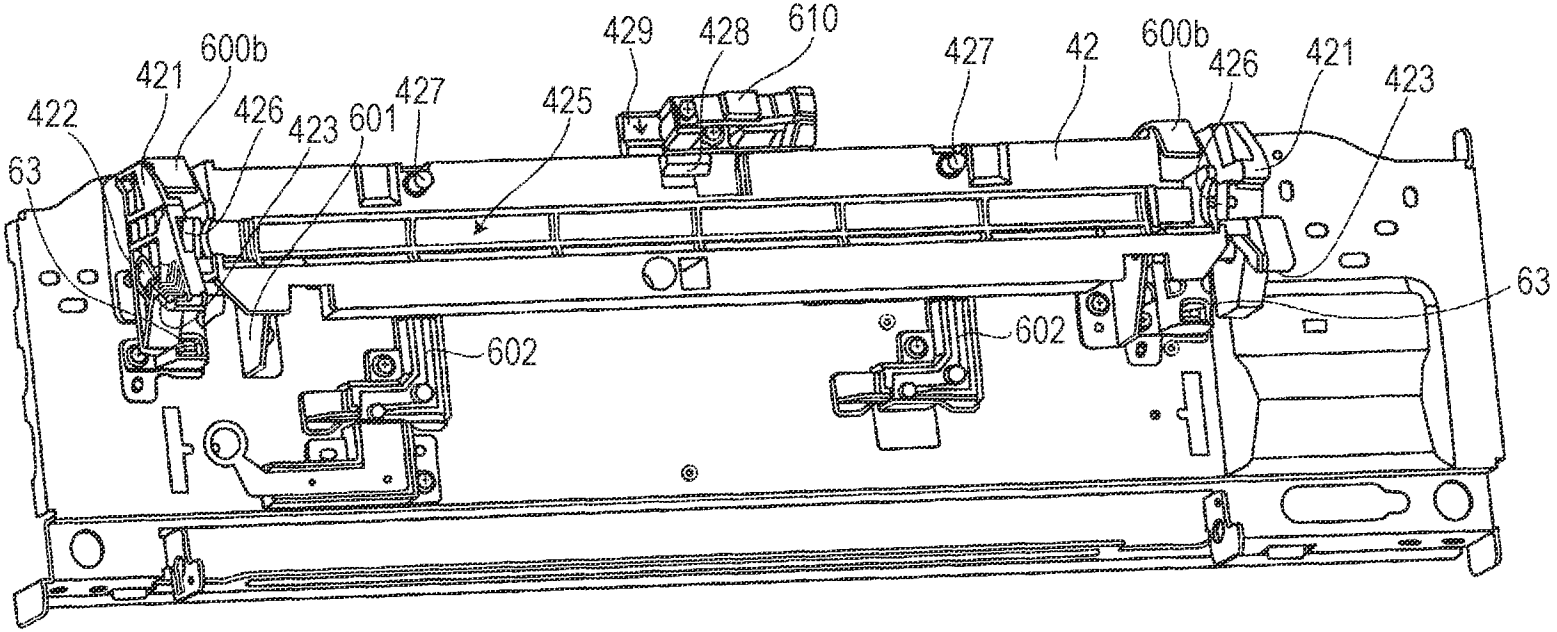
FIG. 6 illustrates a state where, among a support member and a second transfer roller assembly that form a second transfer unit, only the support member is supported on the base plate.

FIG. 6 illustrates a state where, among the support member 42 and a second transfer roller assembly 45 (see FIG. 7) that form the second transfer unit 40, only the support member 42 is supported on the base plate 600.

Figure 7:
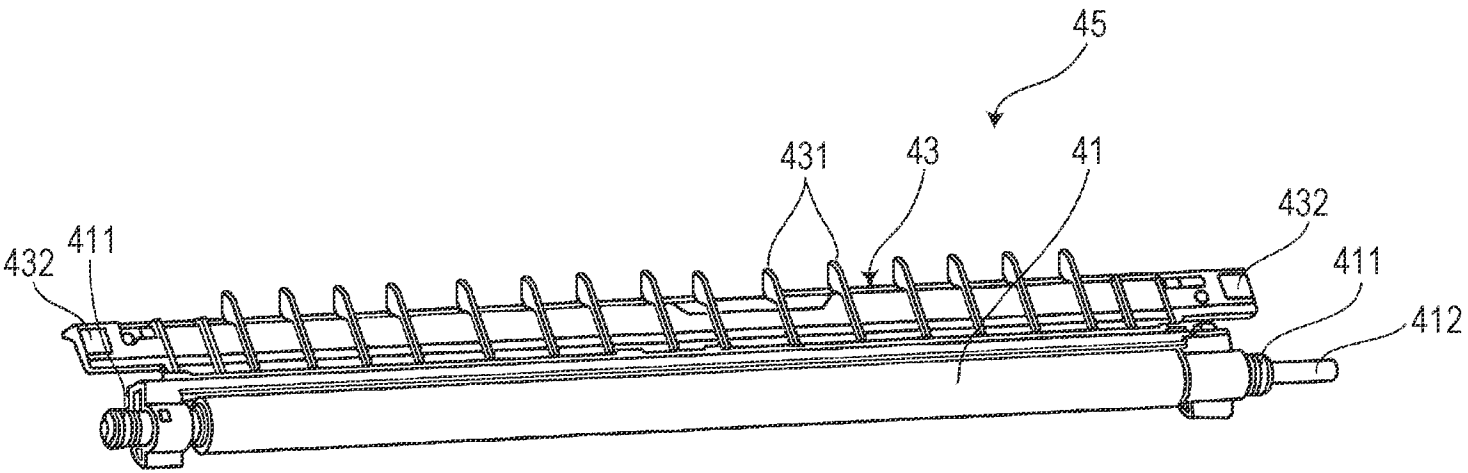
FIG. 7 illustrates the second transfer roller assembly that is to be supported on the support member that is in the state illustrated in FIG. 6.

FIG. 7 illustrates the second transfer roller assembly 45 that is to be supported on the support member 42 that is in the state illustrated in FIG. 6.

FIG. 4 illustrates a state where the second transfer roller assembly 45 illustrated in FIG. 7 is further supported on the support member 42 supported on the base plate 600, which is illustrated in FIG. 6.

Now, the base plate 600 illustrated in FIG. 5 will be described first. Long-hole-restriction-shaft fixing members 601 are fixed to the right and left sides of the base plate 600, and long-hole restriction shafts 62 are fixed to the corresponding long-hole-restriction-shaft fixing members 601. Each long-hole restriction shaft 62 is fixed to the base plate 600 via the corresponding long-hole-restriction-shaft fixing member 601 with a gap between itself and an inner surface 600*a* of the base plate 600 and extends substantially parallel to the center line of rotation of the door 60 (a line that passes through the cutout portion 61 illustrated in FIGS. 1 and 2 and that is perpendicular to the pages of FIGS. 1 and 2 but extends laterally in FIG. 5). The base plate 600 also includes a pair of spring members 602 on right and left sides of a space between the pair of the long-hole restriction shafts 62. The spring members 602 come into contact with the back surface of the support member 42 (see FIG. 6), which faces the base plate 600, and urge the support member 42 in such a direction that the support member 42 is separated from the base plate 600. The support member 42 is to be supported on the base plate 600 and is included in the second transfer unit 40. The spring members 602 each include a spring portion 602*a* that urges the support member 42. The spring members 602 are extended to also serve as conductors, which will not be described here in detail.

Spring members 63 (also see FIG. 3) are disposed on the left and right sides of the base plate 600, at positions between the inner surface 600*a* of the base plate 600 and the long-hole restriction shafts 62. Pressing members 64 are disposed at positions adjacent to the spring members 63. Each pressing member 64 includes two types of rollers that have different diameters and are rotatable independently of each other, i.e., a center roller 641 and side rollers 642 that sandwich the center roller 641. The center roller 641 of the pressing member 64 is disposed in a slit 600*c* (see FIG. 11) in the base plate 600 so as not to interfere with the base plate 600. A circumferential surface of each of the side rollers 642 that sandwich the center roller 641 comes into contact with the base plate 600. Thus, when each pressing member 64 presses against and moves the corresponding spring member 63, the pressing member 64 rotates over the base plate 600. The center roller 641 comes into contact with the pressing-member receiving portion 424 (see FIG. 3) of the support member 42 of the second transfer unit 40. The center roller 641 presses against the pressing-member receiving portion 424 with an urging force of the spring member 63 and rotates over the pressing-member receiving portion 424.

The base plate 600 also includes tongue pieces 600*b* (also see FIG. 3) at such positions that each tongue piece 600*b* and the corresponding pressing member 64 sandwich the corresponding pressing-member receiving portion 424.

A sheet sensor 610 that detects the presence or absence of a sheet that passes therethrough is fixed to the base plate 600.

Now, a second transfer roller assembly 45 illustrated in FIG. 7 will be described.

The second transfer roller assembly 45 includes a second transfer roller 41 and a guide member 43.

As described with reference to FIG. 1, the second transfer roller 41 transfers a toner image on the intermediate transfer belt 31 to a sheet. The guide member 43 is disposed between the second transfer roller 41 and the fixing device 50 (see FIGS. 1 and 2). The guide member 43 guides a sheet that has been subjected to toner image transfer to the fixing device 50 using guide ribs 431 thereof. The second transfer roller 41 includes bearing members 411 that are coaxially supported by a rotation shaft 412 on both outer sides of a region through which a sheet passes. As illustrated with reference to FIG. 3, the bearing members 411 enter the recessed portions 331 of the positioning plates 33 of the intermediate transfer unit 30 and thus are pressed against the recessed portions 331. Thus, a sheet nip portion of the second transfer roller 41 is pressed against the intermediate transfer belt 31. The guide member 43 includes positioned portions 432 on the outer sides of the region through which a sheet passes. As described with reference to FIG. 3, the positioned portions 432 are pressed against the projecting portions 332 of the positioning plates 33 of the intermediate transfer unit 30 and thereby the guide member 43 is positioned.

As illustrated in FIG. 4, the second transfer roller assembly 45 is supported on the support member 42 illustrated in FIG. 6.

Here, the second transfer roller 41 is a consumable article and thus needs to be replaced occasionally. In this exemplary embodiment, the second transfer roller assembly 45 including the second transfer roller 41 is a member that is separate from the support member 42 and thus is favorable in cost reduction since the number of replaced parts is reduced.

As illustrated in FIG. 6, the support member 42 has a recess 425, in which the second transfer roller 41 is disposed, and bearing supporters 426 on both edges thereof, which support the bearing members 411 of the second transfer roller 41. When the bearing members 411 of the second transfer roller 41 are supported by the bearing supporters 426, the base plate 600 supports the second transfer unit 40, which includes the support member 42 and the second transfer roller assembly 45, such that the second transfer roller 41 extends along the base plate 600 and that the rotation shaft of the second transfer roller 41 extends substantially parallel to the center line of rotation of the door 60.

The support member 42 includes side walls 421 at such positions that the side walls 421 sandwich the second transfer roller 41 from both sides in the rotation shaft direction. The side walls 421 extend in such a direction as to intersect a line drawn in the width direction of a sheet, which crosses a direction in which the sheet passes, i.e., in such a direction as to intersect a line extending from the rotation shaft of the second transfer roller 41. The side walls 421 have long holes 422, and the long-hole restriction shafts 62 (see FIG. 5) fixed to the base plate 600 are disposed in the long holes 422 with some play being present.

The support member 42 is supported by the base plate 600 with some play being present, while having the pressing-member receiving portions 424 (see FIG. 3) of the support member 42 sandwiched between the pressing members 64 and the tongue pieces 600*b* of the base plate 600 and having the long-hole restriction shafts 62 disposed in the long holes 422. The back surface of the support member 42 that is supported by the base plate 600 with some play being present is urged by the spring members 602 in such a direction that the support member 42 is separated from the base plate 600.

The support member 42 supports coil springs 427 that press against the second transfer roller assembly 45, which is supported by the support member 42, from the back surface of the second transfer roller assembly 45. The support member 42 includes a lock member 428 and an unlock member 429. The lock member 428 locks the second transfer roller assembly 45 so that the second transfer roller assembly 45 is not easily detached from the support member 42. The unlock member 429 unlocks the second transfer roller assembly 45 locked by the lock member 428 when the unlock member 429 is pressed down.

One of the characteristic points of the second transfer unit 40 is the shape of the long hole 422, which will be described in detail below.

Figure 8:
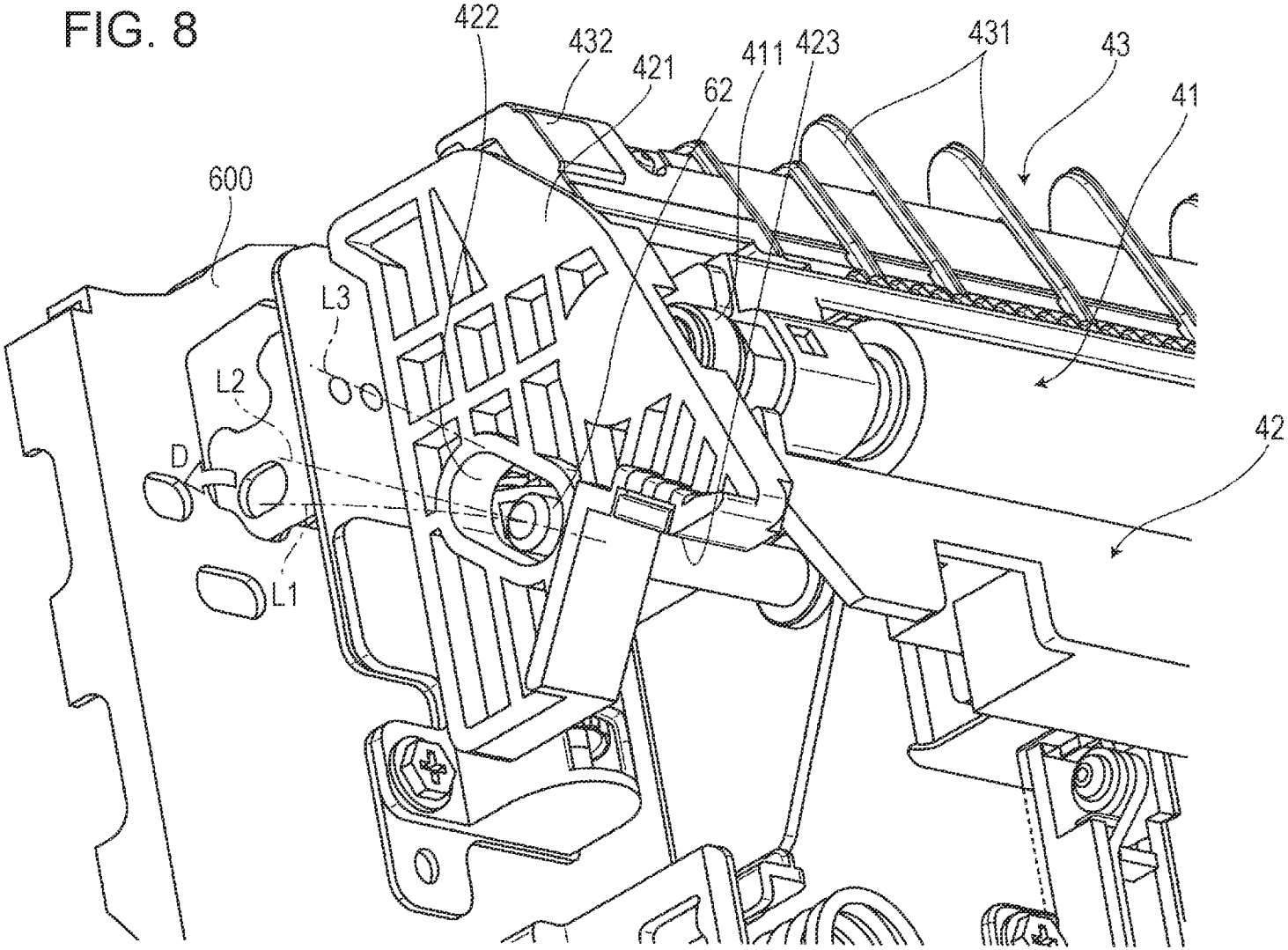
FIG. 8 is an enlarged perspective view illustrating a portion around one side wall of the second transfer unit that is supported on the base plate of the door.

FIG. 8 is an enlarged perspective view illustrating a portion around one of the side walls 421 of the second transfer unit 40 supported by the base plate 600 of the door 60.

FIG. 8 illustrates one long hole 422 in the side wall 421 of the support member 42 and one long-hole restriction shaft 62 that is disposed in the long hole 422 and fixed to the base plate 600. FIG. 8 illustrates a layout for a case where the door 60 (see FIGS. 1 and 2) is closed. When the door 60 is in the closed state, the long-hole restriction shaft 62 is not in contact with a wall surface of the long hole 422.

A dotted-chain line L1 illustrated in FIG. 8 is an arc that passes through the axis of the long-hole restriction shaft 62 and that is drawn from the center of the arc at the center line of rotation of the door 60 (see FIGS. 1 and 2). A dotted-chain line L2 indicates a tangent of the dotted-chain line L1 and the tangent passes through the axis of the long-hole restriction shaft 62. A dotted-chain line L3 is a line extending in a direction of the major axis of the long hole 422. As also illustrated in FIGS. 1 and 2, the arrow D indicates a direction of opening the door 60. As is clear from the dotted-chain lines L1 to L3, the long hole 422 has the major axis that extends in the opening direction of the door 60 away from the center line of rotation of the door 60.

In this exemplary embodiment, the long hole 422 has a wall portion that extends in a planar manner substantially parallel to the major axis direction. However, a long hole according to the present invention is a concept including a long hole that is entirely defined by a curved surface, for example, an elliptic long hole. Effects of the long hole 422 will be described later.

Figure 9:
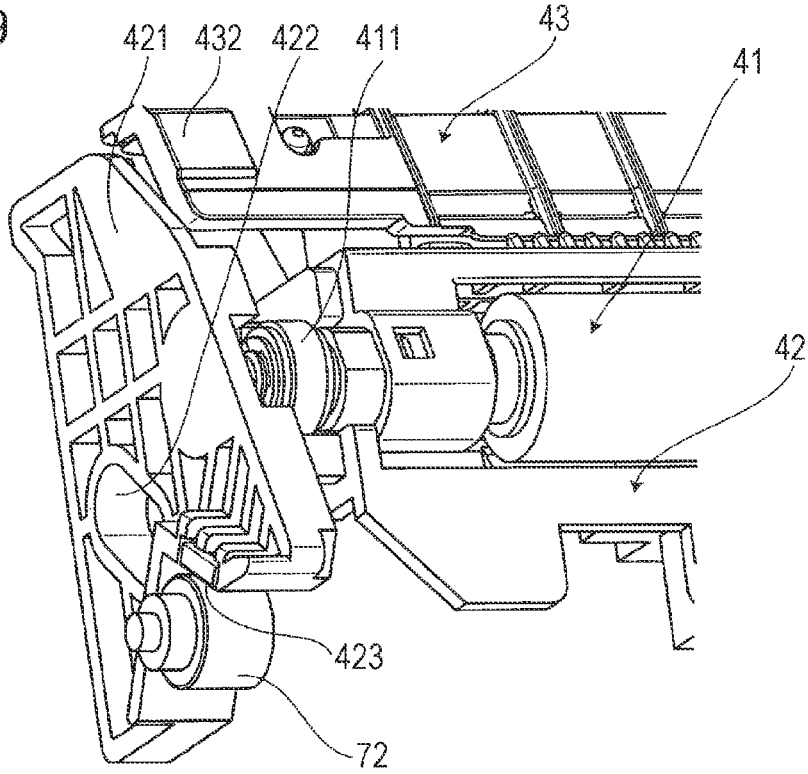
FIG. 9 is a perspective view illustrating a state where a fulcrum portion at a lower end portion of the side wall is pressed against a receiving member that is supported by a body frame.

FIG. 9 is a perspective view illustrating a state where one fulcrum portion 423 at the lower end portion of the corresponding side wall 421 is pressed against the corresponding receiving member 72 that is supported by the body frame 101 (see FIG. 1).

As described above, as the door 60 becomes closed further, the support member 42 rotates by using the fulcrum portion 423, which is pressed against the receiving member 72, as a fulcrum. Thus, by the principle of leverage, the bearing members 411 of the second transfer roller 41 are strongly pressed against the recessed portions 331 (see FIG. 3) of the positioning plates 33 of the intermediate transfer unit 30. Thus, the positioning of the second transfer roller 41 is determined, and the second transfer roller 41 enters a state of pressing against the intermediate transfer belt 31 with a predetermined pressing force.

Figure 10:
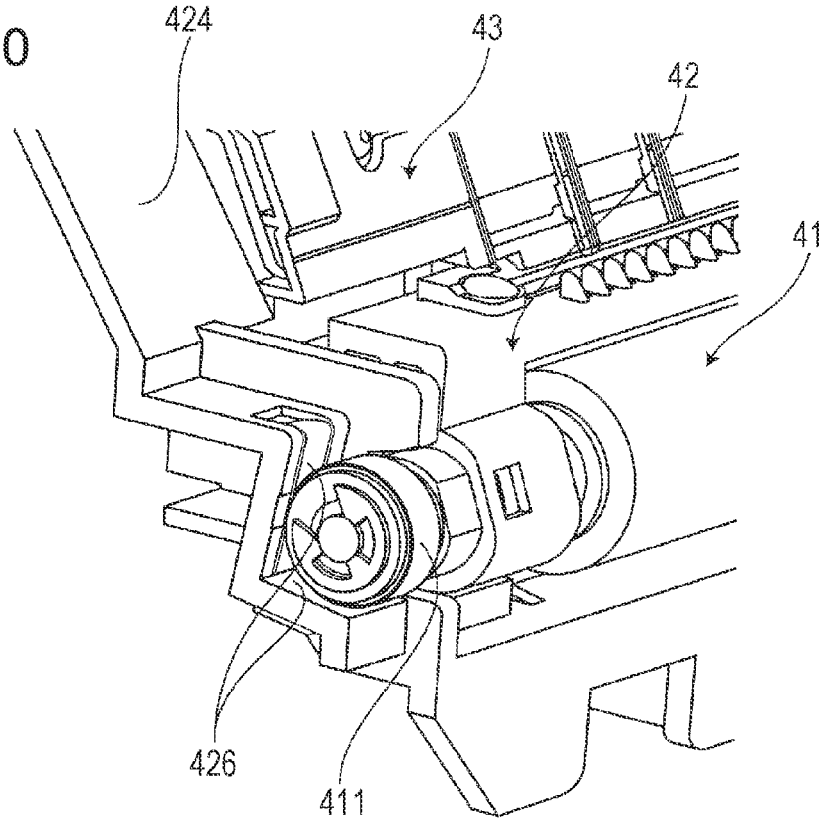
FIG. 10 is an enlarged perspective view illustrating one end portion of a second transfer roller.

FIG. 10 is an enlarged perspective view illustrating one of the end portions of the second transfer roller 41.

FIG. 10 illustrates one bearing member 411 that is supported by the rotation shaft 412 of the second transfer roller 41. The bearing member 411 is supported by the corresponding bearing supporter 426 of the support member 42. When the door 60 is closed, the bearing member 411 is pressed against the recessed portion 331 (see FIG. 3) of the corresponding positioning plate 33 of the intermediate transfer unit 30 and thus is supported and sandwiched by the bearing supporter 426 of the support member 42 and the recessed portion 331 of the positioning plate 33.

Figure 11:
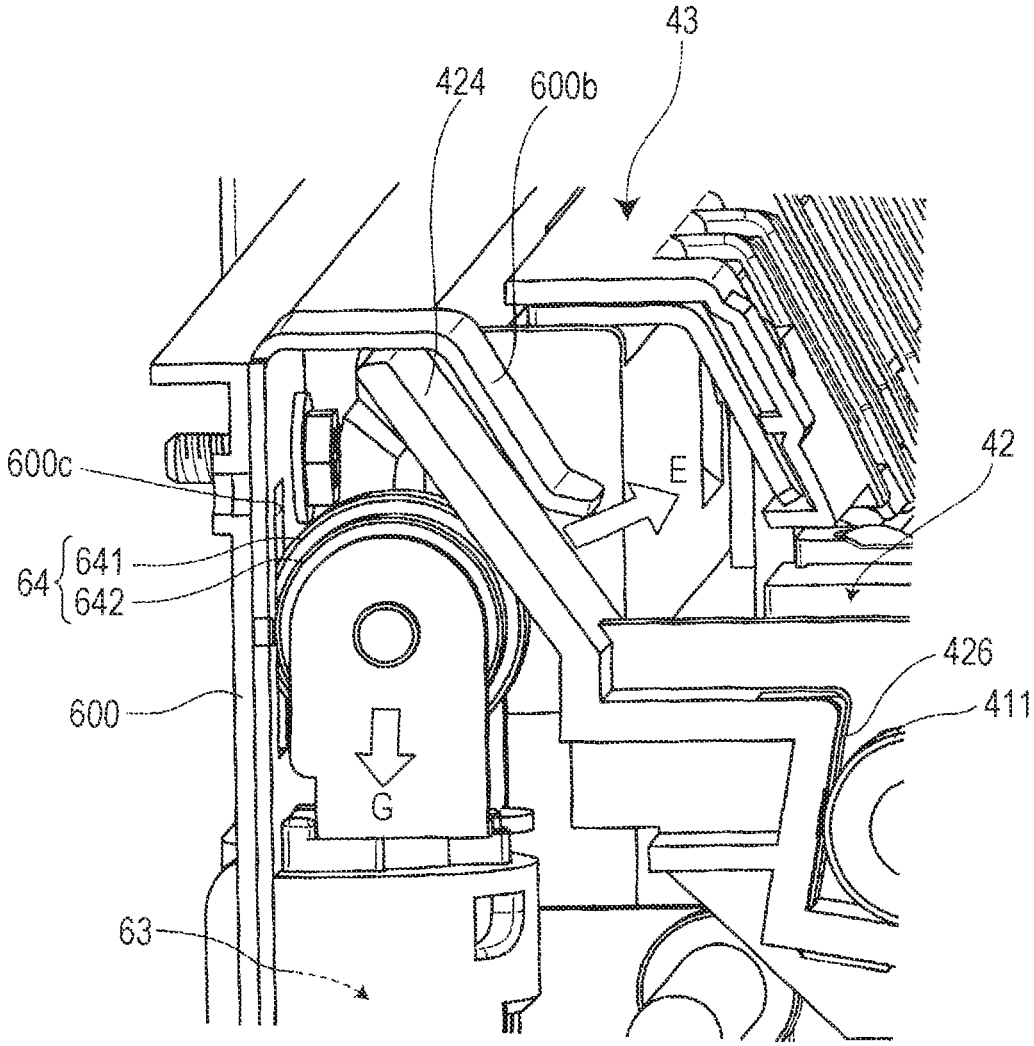
FIG. 11 is an enlarged perspective view of the surrounding of a pressing member.

FIG. 11 is an enlarged perspective view illustrating the surrounding of the pressing member 64.

As described with reference to FIG. 5, each pressing member 64 includes two types of rollers that are rotatable independent of each other, i.e., the center roller 641 and the side rollers 642. The pressing member 64 is urged by the spring member 63 (also see FIG. 3). Among the two types of rollers 641 and 642, the center roller 641 has a larger diameter than the side rollers 642. A part of the larger-diameter center roller 641 is disposed in the slit 600*c* formed in the base plate 600 so as not to interfere with the base plate 600, and is in contact with the pressing-member receiving portion 424 of the support member 42. The smaller-diameter side rollers 642 come into contact with the base plate 600 and are separated from the pressing-member receiving portion 424. As described above, when the door 60 is rotated in the arrow E direction to be in the closed state illustrated in FIGS. 1 and 2 from the open state where the door 60 is opened with respect to the body frame 101, the fulcrum portion 423 positioned at the lower end portion of the side wall 421 is pressed against the receiving member 72 as illustrated in FIG. 9 (also see FIG. 2). When the bearing member 411 of the second transfer roller 41 is pressed against the recessed portion 331 of the positioning plate 33 (see FIG. 3), the pressing member 64 illustrated in FIG. 11 receives a force from the pressing-member receiving portion 424 of the support member 42 while being sandwiched by the pressing-member receiving portion 424 and the base plate 600, and then is moved downward (in the direction indicated by an arrow G in FIG. 11). Here, the pressing member 64 that includes the two types of rollers 641 and 642 moves in the arrow G direction, while the center roller 641 is rotated by being pressed by the pressing-member receiving portion 424 and the side rollers 642 rotate over the base plate 600 in a direction that is opposite to that of the center roller 641. When the pressing member 64 moves in the arrow G direction, the spring member 63 that is adjacent to the pressing member 64 is compressed. Thus, the urging force of the spring member 63 is increased and the pressing member 64 strongly presses against the pressing-member receiving portion 424 in the arrow E direction (i.e., the direction of closing the door 60 that is illustrated in FIGS. 1 and 2). In this manner, the fulcrum portion 423 that is located at the lower end portion of the side wall 421 of the support member 42 and that is pressed against the receiving member 72 serves as a fulcrum, the pressing-member receiving portion 424 of the support member 42 that is pressed by the pressing member 64 serves as a point of effort, and the bearing member 411 of the second transfer roller 41 that is pressed against the recessed portion 331 of the positioning plate 33 of the intermediate transfer unit 30 serves as a point of resistance. Thus, the bearing member 411 is strongly pressed against the recessed portion 331 with a predetermined pressing force.

Figure 12:
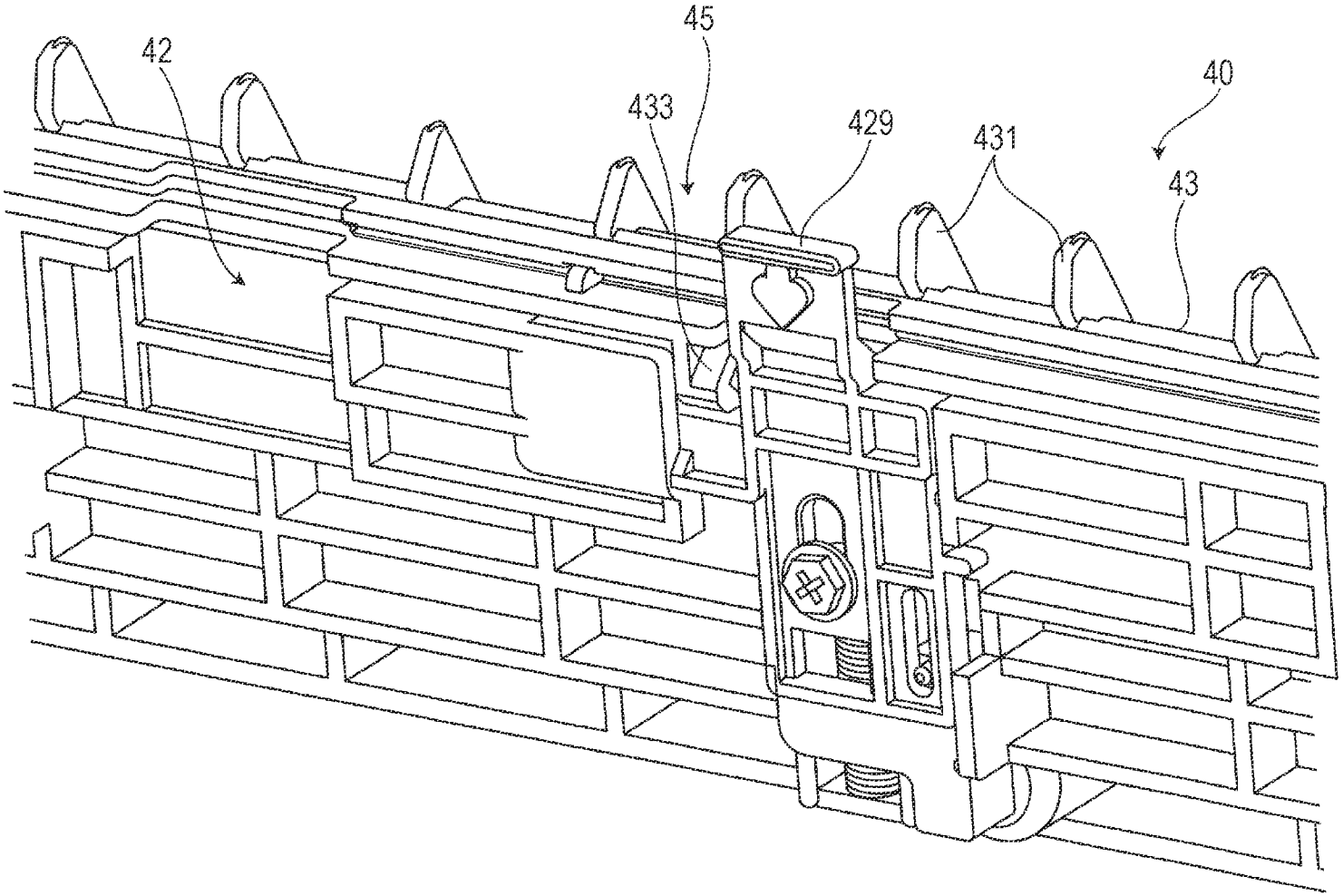
FIG. 12 is a partial enlarged perspective view of the second transfer unit seen from the rear side of the support member.

FIG. 12 is a partial enlarged perspective view of the second transfer unit 40 seen from the rear side of the support member 42.

FIG. 12 illustrates the unlock member 429 (also see FIG. 6) that unlocks the second transfer roller assembly 45 locked by the support member 42.

Figure 13:
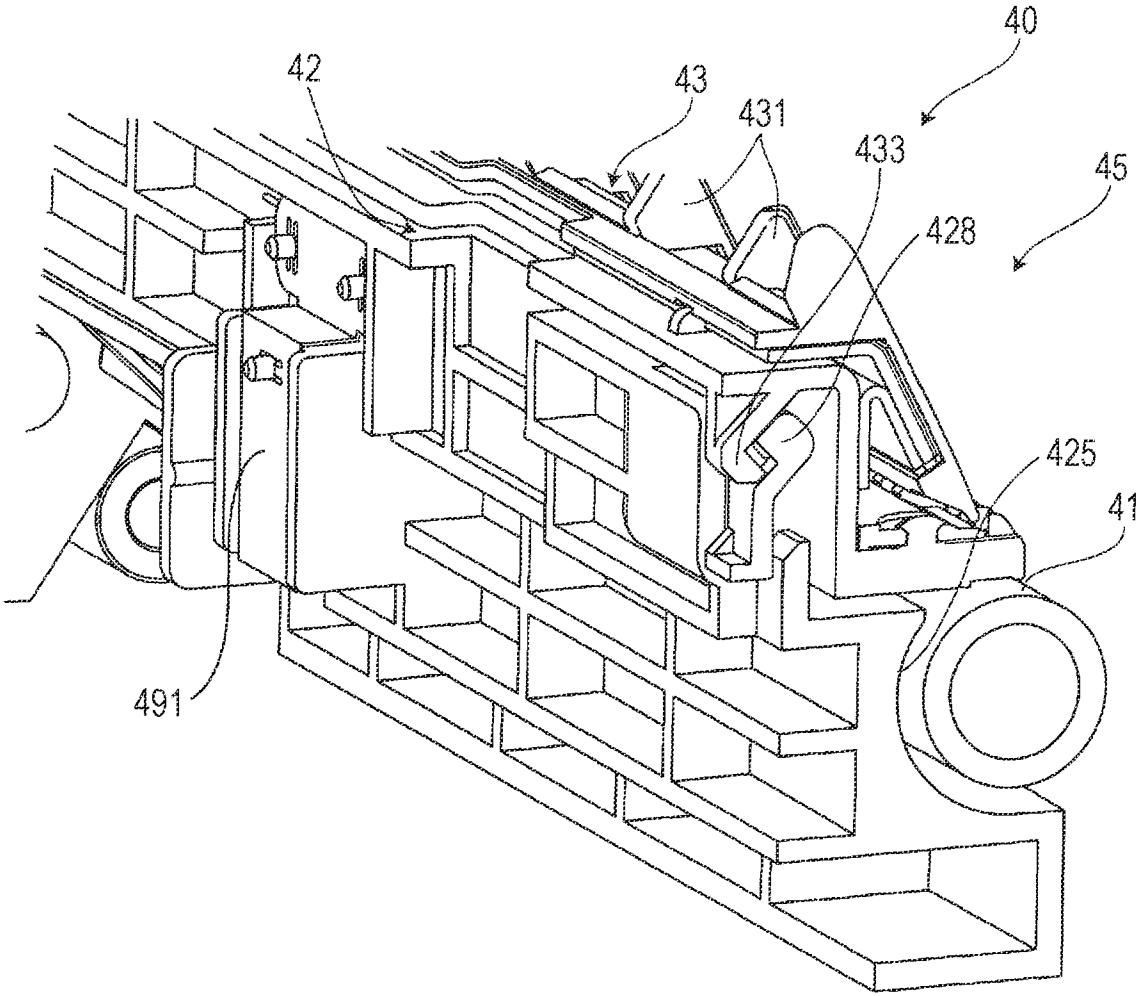
FIG. 13 is an enlarged sectional perspective view of lock members of the support member and the second transfer roller assembly.

FIG. 13 is an enlarged sectional perspective view of a lock member 428 of the support member 42 and a lock member 433 of the second transfer roller assembly 45.

FIG. 13 illustrates the lock member 428 (also see FIG. 6) of the support member 42 and the lock member 433 (also see FIG. 12) of the second transfer roller assembly 45, which are locked together.

When the unlock member 429 illustrated in FIGS. 6 and 12 is pressed down, the lock members 428 and 433 are unlocked and thus the second transfer roller assembly 45 is dismountable from the support member 42.

As described above, the second transfer roller assembly 45 is configured to be supported by the support member 42 as a component that is separate from the support member 42. This configuration is favorable in terms of cost since only the second transfer roller assembly 45 needs to be replaced when the second transfer roller 41 is exhausted. Furthermore, forming the second transfer roller assembly 45 as a separate component is useful in an accurate positioning of the guide member 43, as will be described with reference to FIG. 14.

Plates 491 that serve as conductors and one of which is illustrated in FIG. 13 are fixed to the back surface of the support member 42. Each spring member 602 that is illustrated in FIG. 5 and that presses against the back surface of the support member 42 is in contact with the corresponding one of the plates 491 and presses against the plate 491. Thus, an electrical contact between the plates 491 and the corresponding spring members 602 is established.

Figure 14:
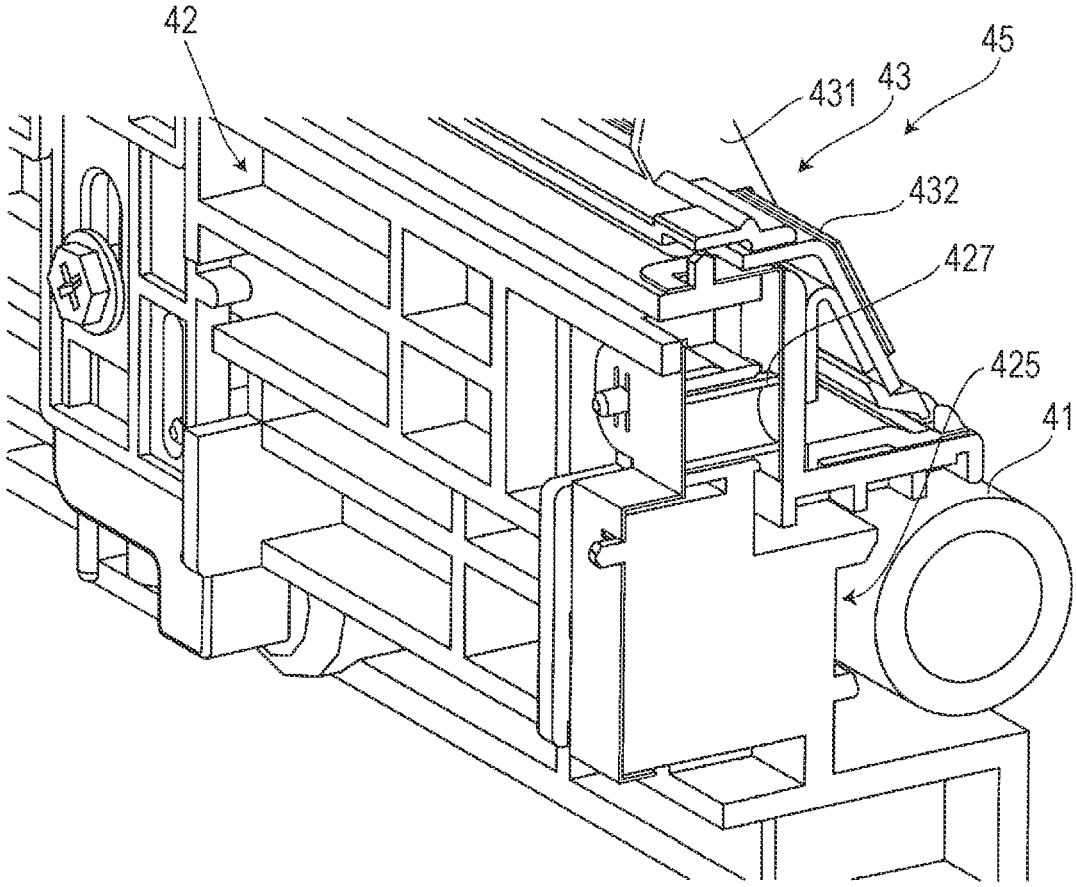
FIG. 14 is a partial enlarged sectional view illustrating a coil spring of the second transfer unit.

FIG. 14 is a partial enlarged perspective sectional view illustrating one coil spring 427 of the second transfer unit 40.

The second transfer roller assembly 45 is urged by the coil springs 427 (also see FIG. 6) in such a direction as to be separated from the support member 42. When the second transfer roller assembly 45 is urged by the coil springs 427 and the positioned portions 432 of the guide member 43 are pressed against the projecting portions 332 (see FIGS. 2 and 3) of the positioning plates 33 of the intermediate transfer unit 30, the guide member 43 is accurately positioned at a position that is appropriate for guiding a sheet to the fixing device 50.

Figure 20:
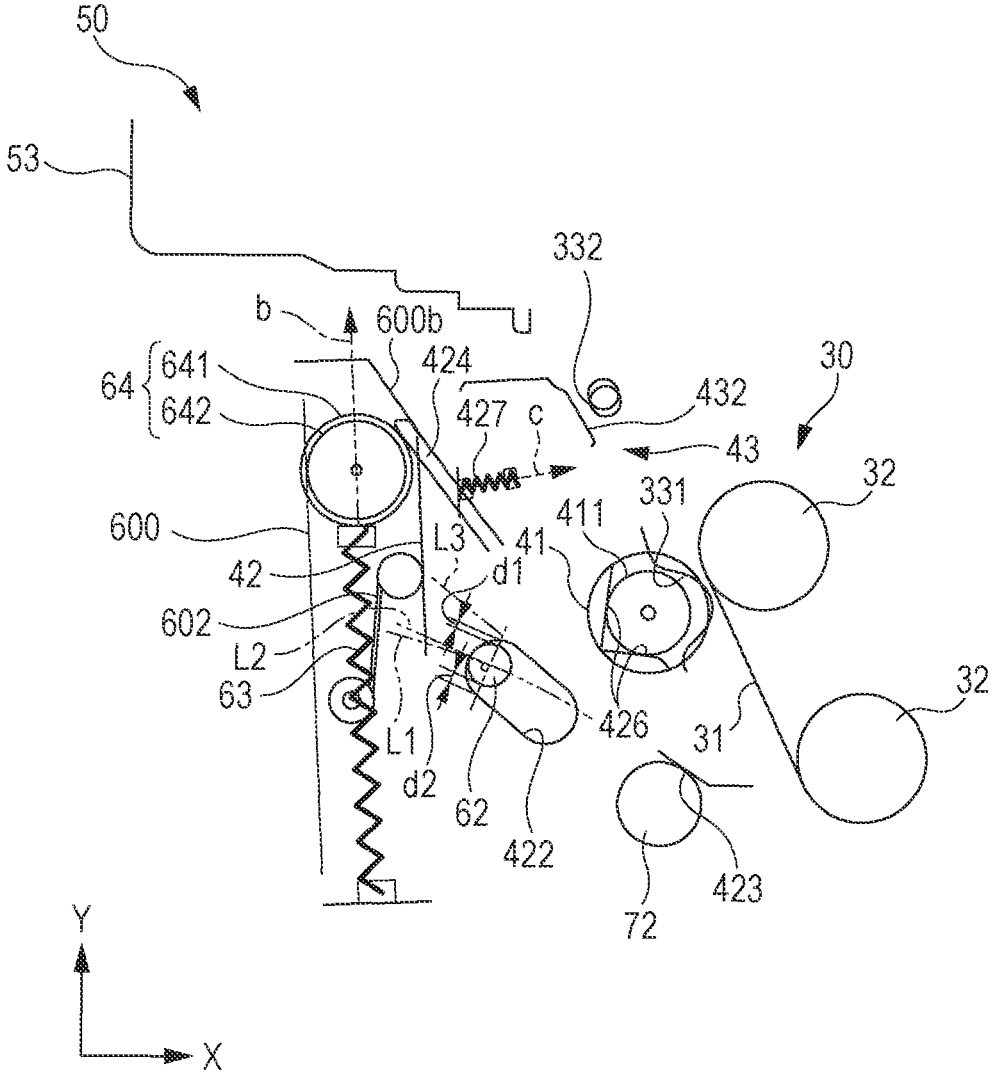
FIG. 20 is a schematic view illustrating the positions of the components while the door is being rotated from the open state to the closed state.
Figure 21:
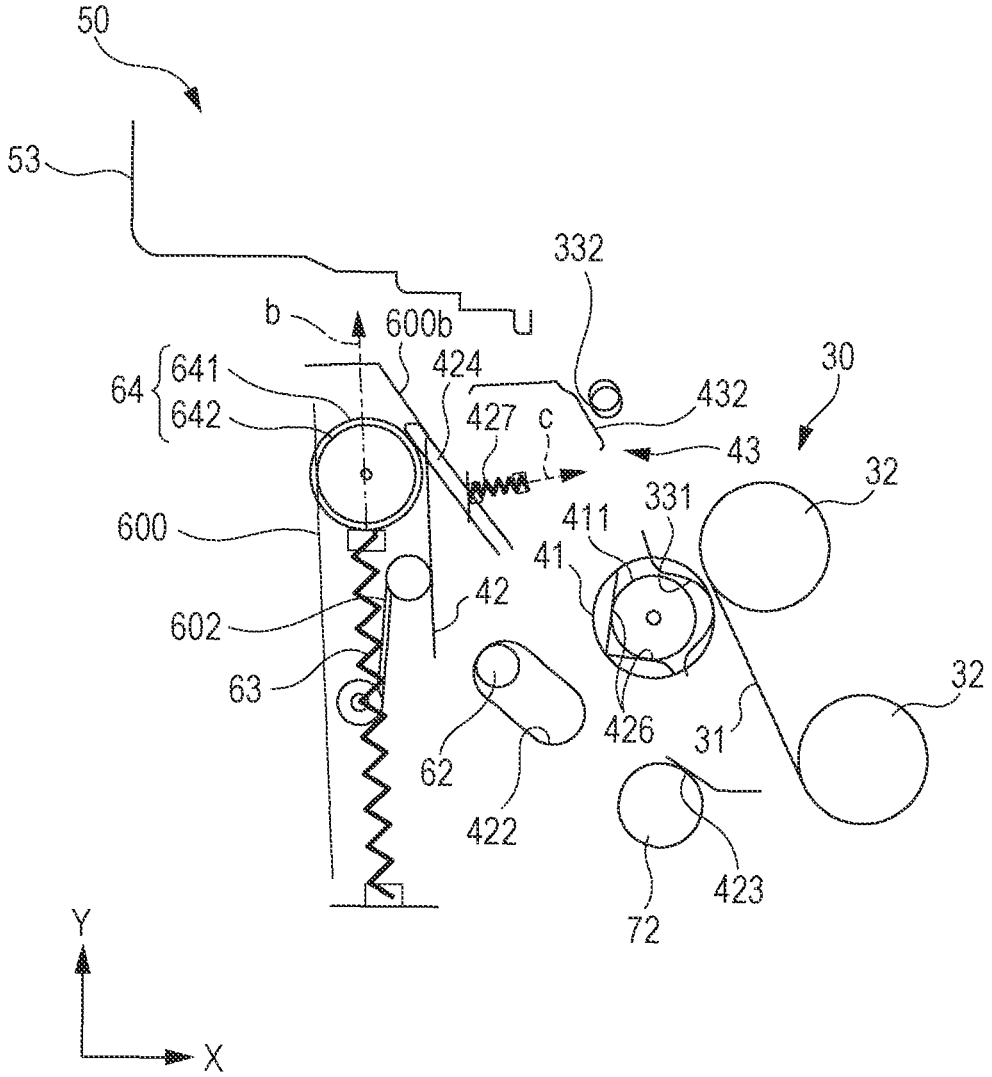
FIG. 21 is a schematic view illustrating the positions of the components while the door is being rotated from the open state to the closed state.
Figure 22:
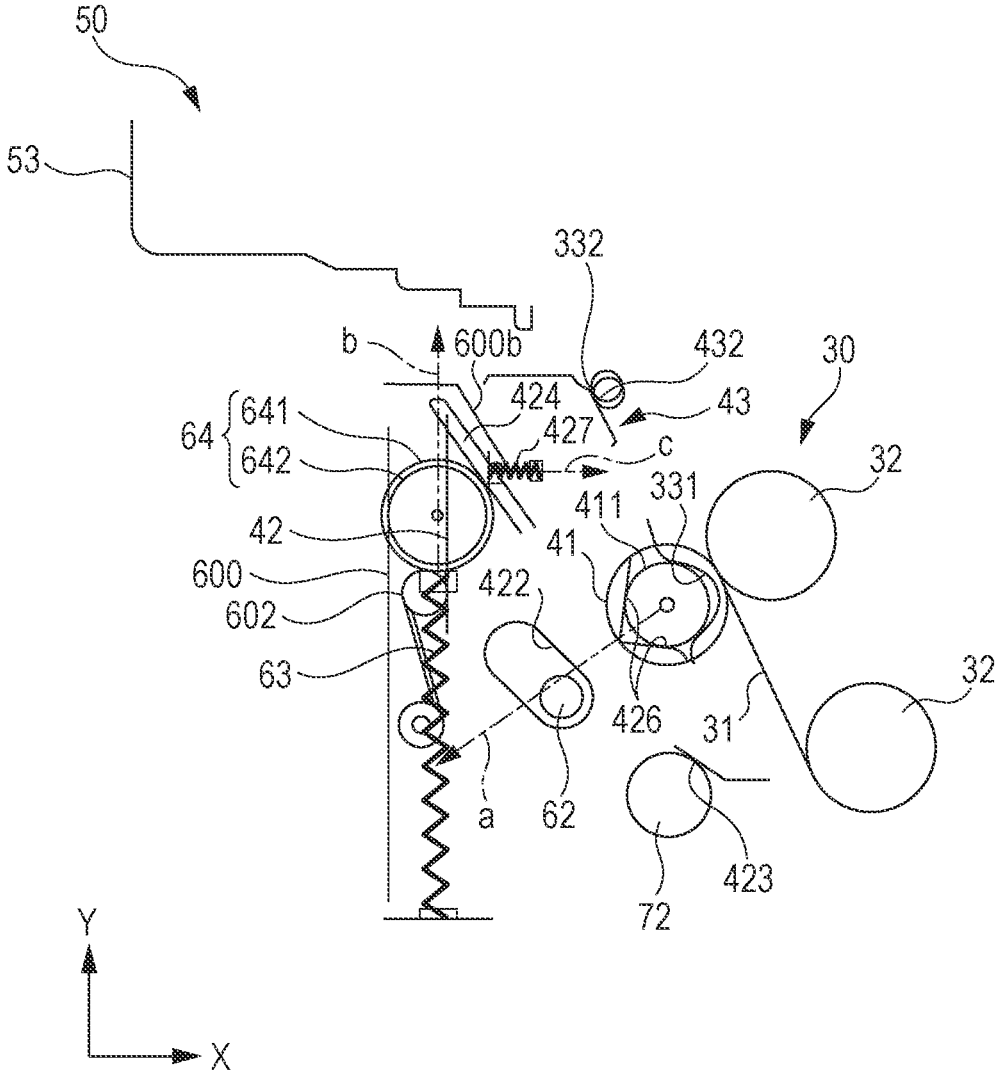
FIG. 22 is a schematic view illustrating the positions of the components when the door is in the closed state.

FIGS. 15 to 22 are schematic views illustrating the positions of components when the door 60 is rotated from the open state to the closed state. Among FIGS. 15 to 22, FIG. 15 is a view of when the door 60 is in the open state and FIG. 22 is a view of when the door 60 is in the closed state.

Firstly, with reference to FIG. 22, which is a view of when the door 60 is in the closed state, the relationship between components drawn in FIG. 15 to FIG. 22 and the components described with reference to FIGS. 1 to 14 will be described.

The two rollers 32 and the intermediate transfer belt 31 that is wound around the two rollers 32, which are included in the intermediate transfer unit 30, are illustrated as being on the right side of FIG. 22. The recessed portion 331 of one positioning plate 33 (see FIGS. 2 and 3) of the intermediate transfer unit 30 is illustrated at a position that is adjacent to the intermediate transfer belt 31, and the projecting portion 332 of the positioning plate 33 is schematically illustrated as being at a position upward and to the left of the recessed portion 331.

The bearing member 411 of the second transfer roller 41 enters the recessed portion 331, and thus presses against the recessed portion 331 with a predetermined force. FIG. 22 also illustrates the bearing supporter 426 (see FIG. 10) of the support member 42 that sandwiches the bearing member 411 together with the recessed portion 331, and the second transfer roller 41 that is coaxial with the bearing member 411 and that is in a state of pressing against the intermediate transfer belt 31. The positioned portion 432 (see FIG. 4) of the guide member 43 is in contact with the projecting portion 332.

In FIG. 22, the receiving member 72 (see FIGS. 2 and 9) fixed to the body frame 101 (see FIG. 1) is illustrated as being under the second transfer roller 41. The receiving member 72 is pressed by the fulcrum portion 423 (see FIGS. 2 and 9) located at the lower end portion of the side wall 421 of the support member 42.

The long-hole restriction shaft 62 is disposed in the long hole 422 formed in the side wall 421, with some play being present (see FIG. 8). When the door 60 is in the closed state, the long-hole restriction shaft 62 is separated from the wall surface of the long hole 422.

The base plate 600 disposed on the inner side of the door 60, the spring member 63 attached to the base plate 600, and the pressing member 64 that is urged by the spring member 63 are illustrated as being on the left side of FIG. 22. FIG. 22 also illustrates the tongue piece **600*b* of the base plate 600 and the pressing-member receiving portion 424 (see FIG. 11) of the support member 42 that is interposed between the tongue piece 600*b* and the pressing member 64. As described above, the center roller 641 among the two types of rollers 641 and 642 of the pressing member 64 is in contact with the pressing-member receiving portion 424 and the side rollers 642 are in contact with the base plate 600**.

FIG. 22 also illustrates the spring member 602 (see FIG. 5) that is supported by the base plate 600 and that presses against the back surface of the support member 42, and the coil spring 427 (see FIGS. 6 and 14) that is supported by the support member 42 and that presses against the second transfer roller assembly 45. Further, the profile of the casing 53 of the fixing device 50 is illustrated in an upper portion of FIG. 22.

In FIG. 22, an arrow a indicates the direction and the strength of a force that the bearing member 411 receives from the recessed portion 331, an arrow b indicates the direction and the strength of a force that the pressing member 64 receives from the spring member 63, and an arrow c indicates the direction and the strength of a force with which the coil spring 427 presses against the back surface of the second transfer roller assembly 45.

Figure 15:
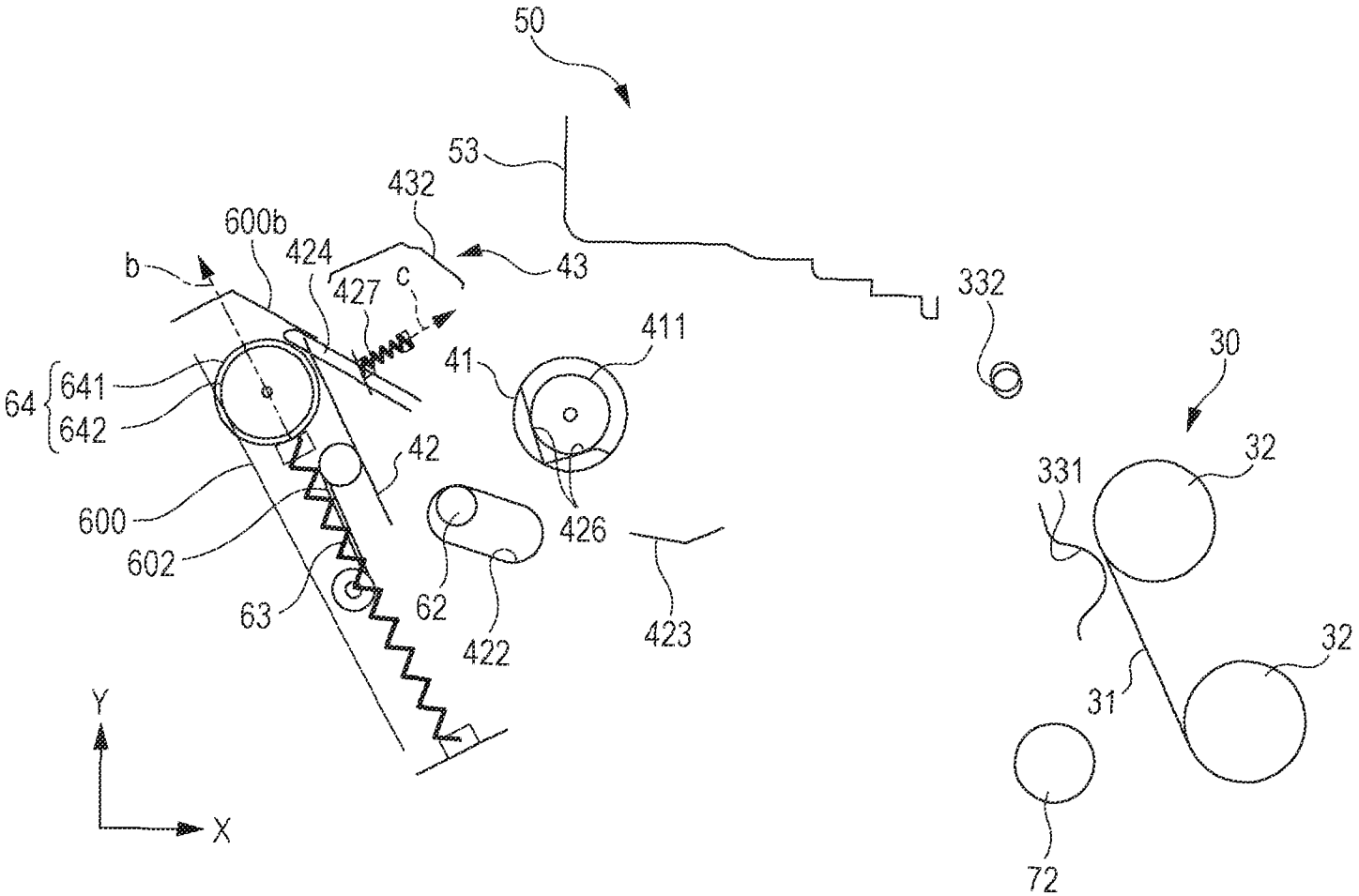
FIG. 15 is a schematic view illustrating the positions of the components when the door is in the open state.

Now, movement of the components will be sequentially illustrated from the open state in FIG. 15 to the closed state in FIG. 22.

Figure 16:
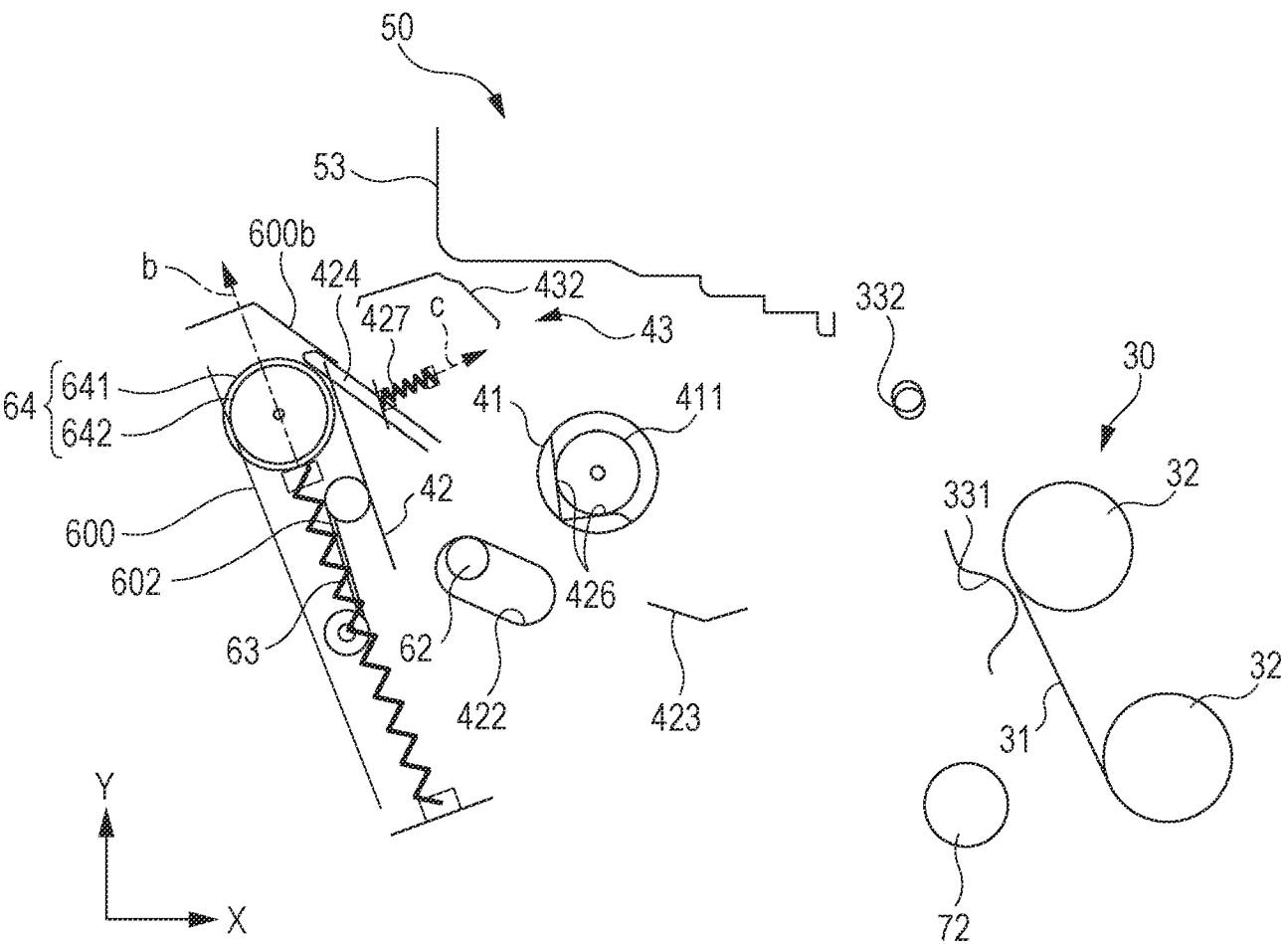
FIG. 16 is a schematic view illustrating the positions of the components while the door is being rotated from the open state to the closed state.
Figure 17:
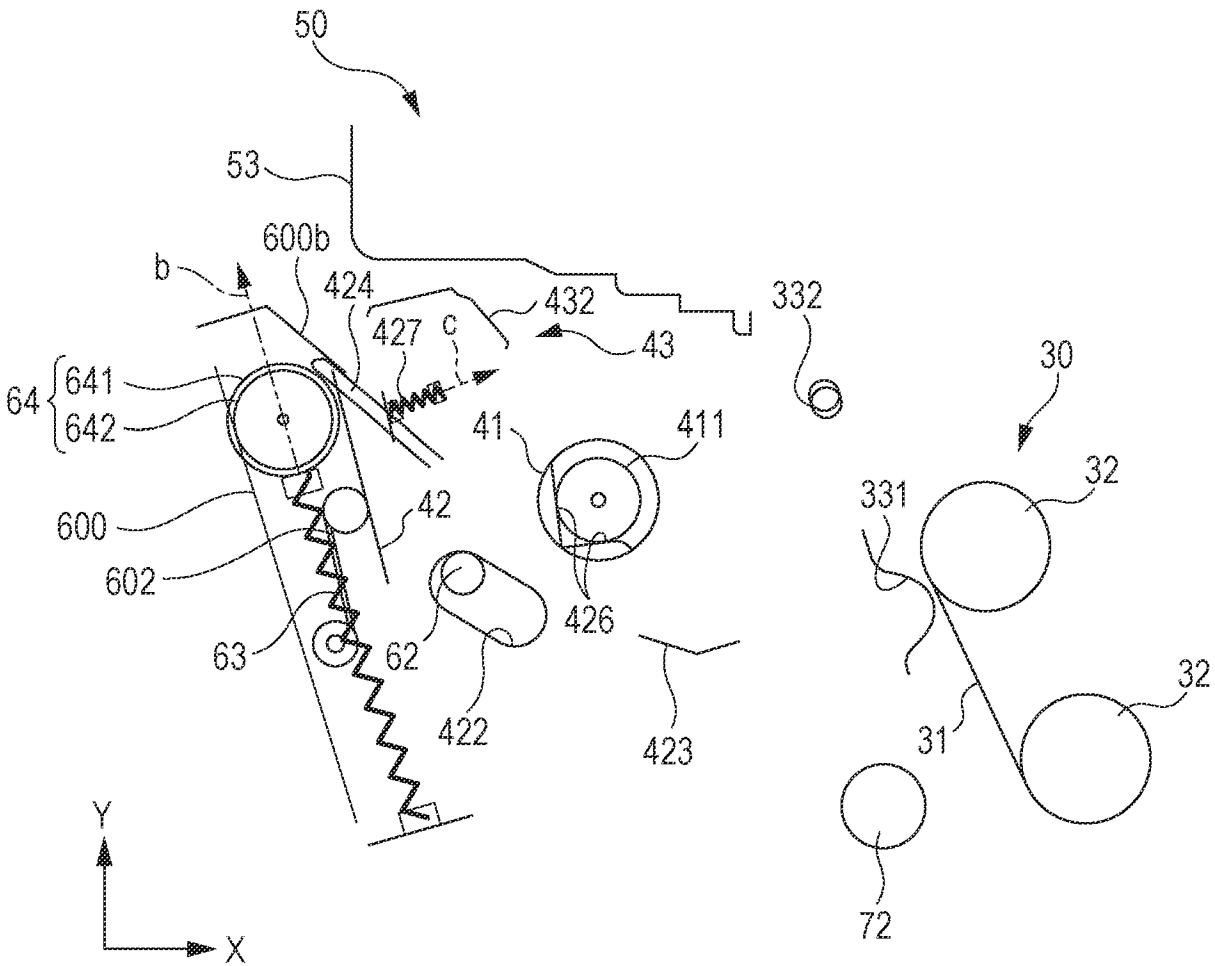
FIG. 17 is a schematic view illustrating the positions of the components while the door is being rotated from the open state to the closed state.
Figure 18:
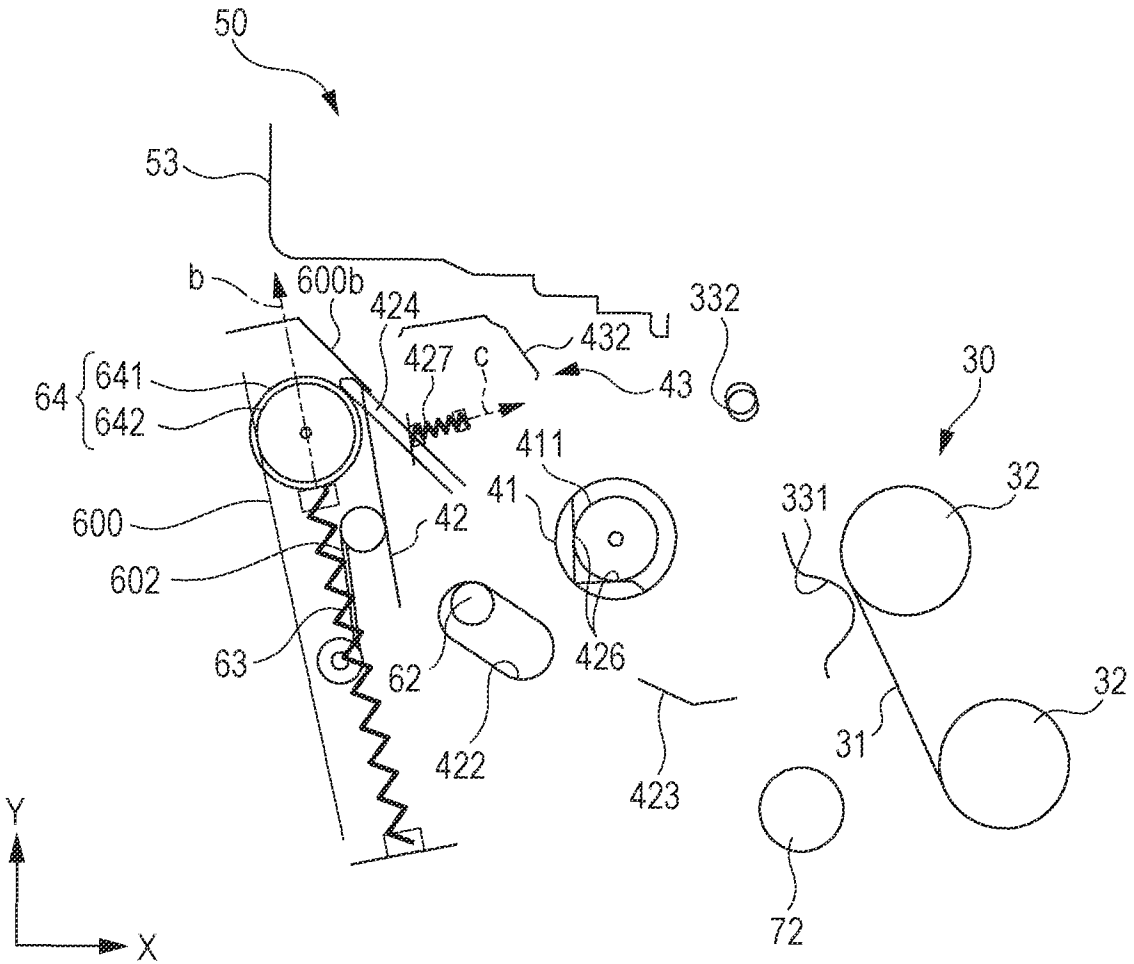
FIG. 18 is a schematic view illustrating the positions of the components while the door is being rotated from the open state to the closed state.
Figure 19:
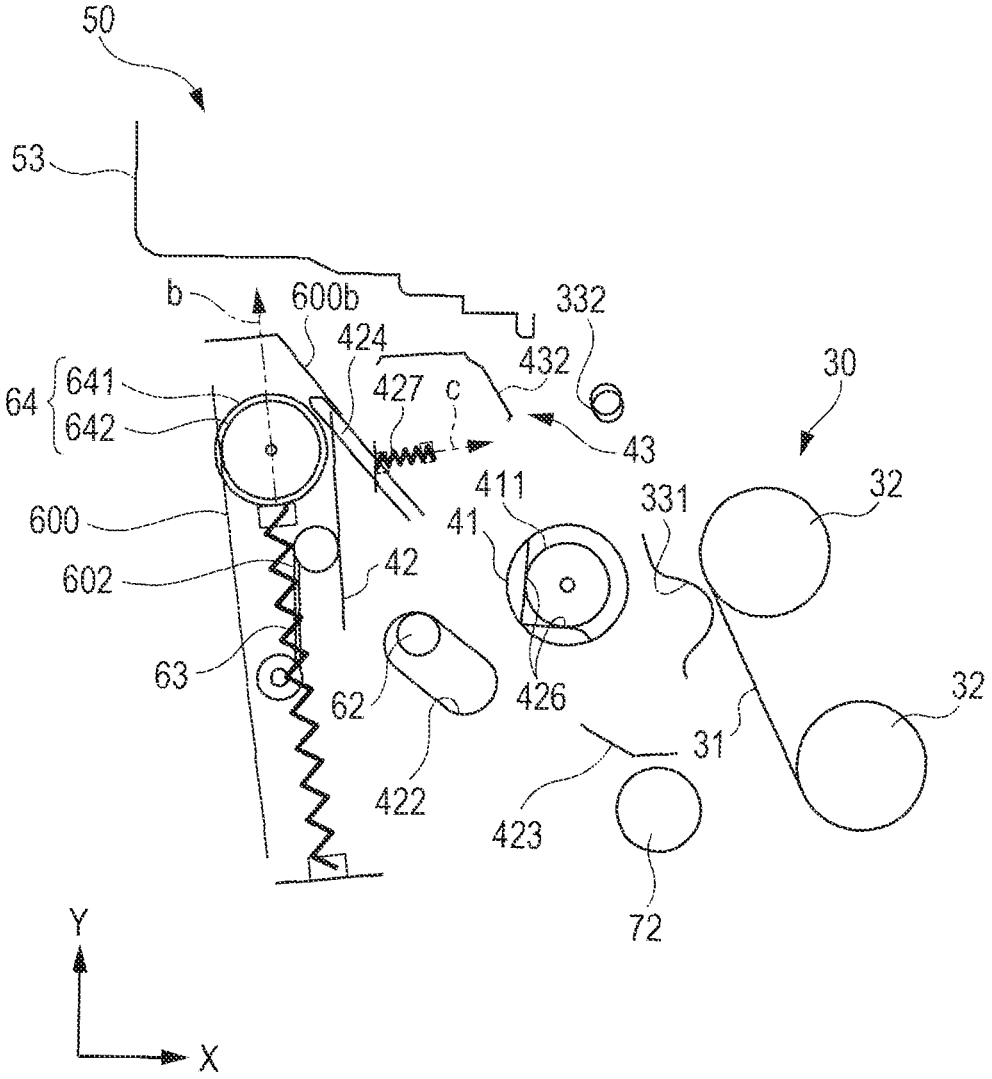
FIG. 19 is a schematic view illustrating the positions of the components while the door is being rotated from the open state to the closed state.

When the door 60 is closed by a small amount from the open state in FIG. 15 and enters the state illustrated in FIG. 16, the guide member 43 reaches a point that is proximate to the casing 53 of the fixing device 50 arranged right above the guide member 43. The guide member 43, however, does not come into contact with the casing 53 of the fixing device 50 and passes through the proximate point (see FIG. 17). As the door 60 is closed further, the components move as illustrated in FIGS. 18 and 19. In the state illustrated in FIG. 19, the fulcrum portion 423 is at a position that is still separated from the receiving member 72. From the state illustrated in FIG. 15, which is the open state, to the state illustrated in FIG. 19, the long-hole restriction shaft 62 is in contact with a topmost portion of the wall surface of the long hole 422.

FIG. 20 illustrates the state where the door 60 is further rotated in the closing direction from the state in FIG. 19, and the fulcrum portion 423 is pressed against the receiving member 72. The bearing member 411 is still separated from the recessed portion 331. When the fulcrum portion 423 is pressed against the receiving member 72, the positional relationship between the long hole 422 and the long-hole restriction shaft 62 is changed as illustrated in FIG. 20. Specifically, in the state illustrated in FIG. 19, the long-hole restriction shaft 62 is in contact with the topmost portion of the wall surface of the long hole 422. However, when the fulcrum portion 423 is pressed against the receiving member 72, the long-hole restriction shaft 62 moves to the below-described position with respect to the long hole 422, as illustrated in FIG. 20. Specifically, the long-hole restriction shaft 62 moves to such a position that there are gaps d1 and d2 between the long-hole restriction shaft 62 and the wall surface of the long hole 422 on both sides of the long-hole restriction shaft 62 in a radial direction crossing an arc (dotted-chain line L1) that is drawn from the center of the arc at the center line of rotation of the door 60 and that passes through the long-hole restriction shaft 62. In this exemplary embodiment, since the long hole 422 has a major axis that extends in the opening direction of the door 60 away from the center line of rotation of the door 60, the above positional relationship is achieved.

The positional relationship between the long-hole restriction shaft 62 and the long hole 422 is maintained in the subsequent state (FIG. 21) in which the bearing member 411 starts coming into contact with the recessed portion 331. Thus, even when the recessed portion 331 and the bearing member 411 have some dimensional variations, the bearing member 411 is guided into the recessed portion 331 while the variations are dealt with since the long-hole restriction shaft 62 is vertically movable in the long hole 422. With this positional relationship, users no longer feel awkward about the bearing member becoming caught at an entrance edge of the recessed portion when closing the door, although this problem remains in the structures of the related art. Thus, the users are able to feel that the door is smoothly operable because of the smooth change in amount of the operational force.

Next, FIG. 15 to FIG. 22 will be referred to in reverse order to describe movement of the components from when the door 60 is in the closed state as illustrated in FIG. 22 to when the door 60 is in the open state as illustrated in FIG. 15.

When the door 60 is in the closed state as illustrated in FIG. 22, the long-hole restriction shaft 62 disposed in the long hole 422 is separated from the wall surface of the long hole 422.

When the door 60 starts being opened from the closed state illustrated in FIG. 22, the long-hole restriction shaft 62 comes into contact with a portion of the wall surface of the long hole 422 that is positioned to be lower than the topmost portion of the wall surface, as illustrated in FIG. 21. As the door 60 is rotated further toward the open state, the fulcrum portion 423 illustrated in FIG. 20 and pressing against the receiving member 72 is separated from the receiving member 72 as illustrated in FIG. 19, and thus the long-hole restriction shaft 62 comes into contact with the topmost portion of the wall surface of the long hole 422. As described above, the long-hole restriction shaft 62 is fixed to the base plate 600 (see FIG. 5), and the second transfer unit 40, which includes the support member 42 and the second transfer roller assembly 45, is supported by the base plate 600 with some play being present. Thus, the long-hole restriction shaft 62 comes into contact with the topmost portion of the wall surface of the long hole 422 as illustrated in FIG. 19, not because the long-hole restriction shaft 62 rises, but because the second transfer unit 40 in which the long hole 422 is formed descends downward due to gravity. Since the guide member 43 is included in the second transfer unit 40, the guide member 43 also descends downward, accordingly. Since the guide member 43 descends downward in the above manner, the guide member 43 is capable of passing under the fixing device 50 without interfering with the casing 53 of the fixing device 50, as illustrated in FIG. 16.

Figure 23:
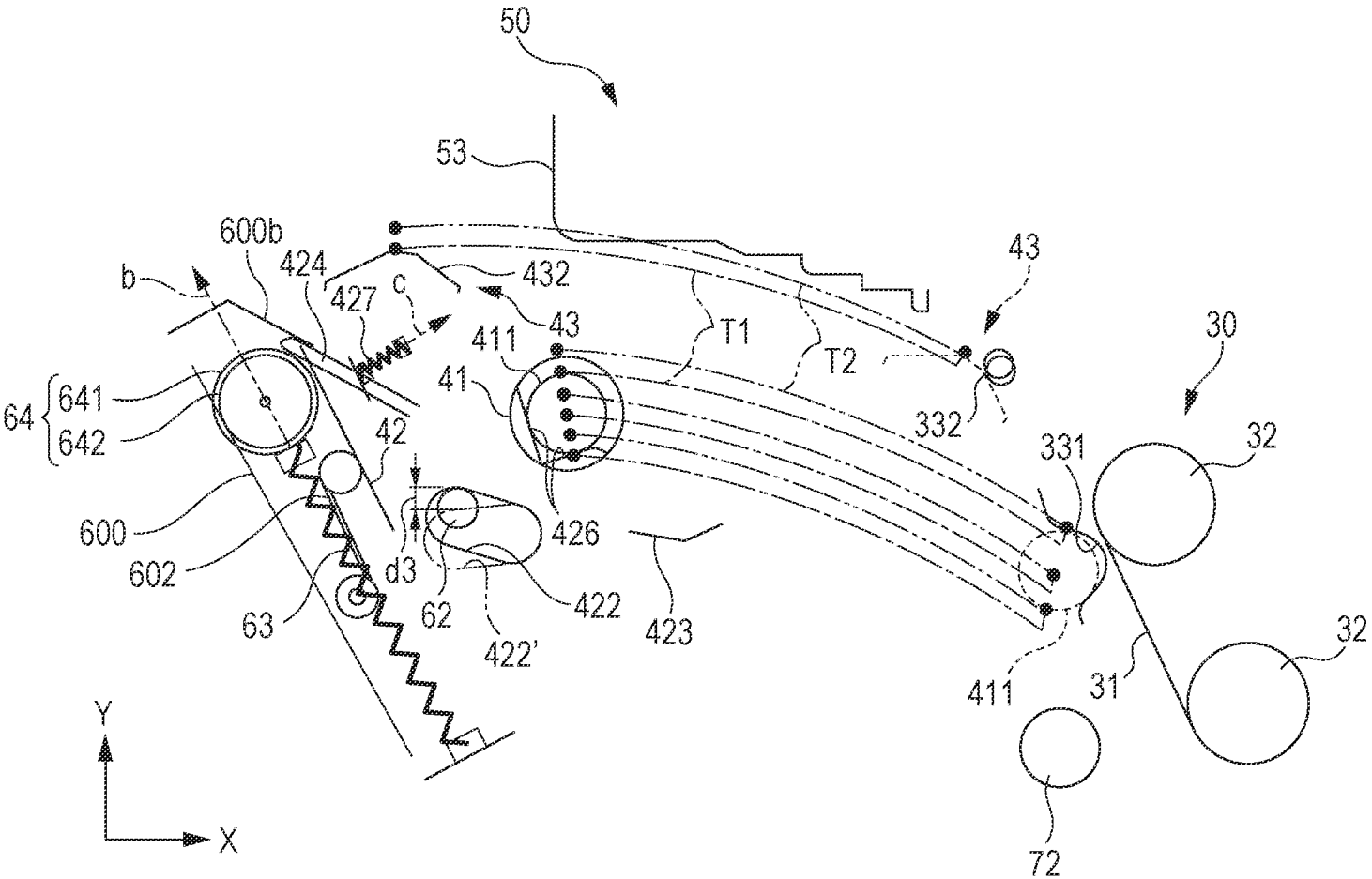
FIG. 23 illustrates trajectories along which a bearing member and a guide member move when the door is opened and closed.

FIG. 23 illustrates trajectories along which the bearing member 411 and the guide member 43 move when the door 60 is opened and closed.

FIG. 23 also illustrates a long hole 422', as a comparative example, which has a major axis that extends in substantially the same direction as the trajectories made when the door 60 is opened and closed (arcs drawn from the center at the center line of rotation of the door 60). In FIG. 23, trajectories T1 drawn with dotted-chain lines are ones that are made in the exemplary embodiment, while trajectories T2 drawn with two-dot chain lines are ones that would be made in a case where the long hole 422' according to the comparative example is provided instead of the long hole 422 according to the exemplary embodiment and where the long-hole restriction shaft 62 is disposed in the long hole 422'.

In the case of the exemplary embodiment, the second transfer unit 40 is allowed to descend further downward than in the case of the comparative example by a distance corresponding to a distance d3. Thus, the trajectories T1 drawn with the dotted-chain lines are obtainable in the exemplary embodiment. On the other hand, the trajectories T2 drawn with two-dot chain lines are formed in the case of the comparative example. As a consequence, if the door 60, which is in the closed state, is to be opened, the guide member 43 would interfere with the casing 53 of the fixing device 50 and the door 60 would fail to be opened. To address this situation, a layout change or the like would be needed, such as mounting the fixing device 50 at a higher position, but this would lead to an increase in the size of the apparatus.

As illustrated by the trajectories T2 drawn with the two-dot chain lines, the bearing member 411 traces such trajectories that the bearing member 411 interferes with the entrance edge of the recessed portion 331. Thus, when the door 60, which is in the open state, is closed, the bearing member 411 fails to smoothly enter the recessed portion 331. The bearing member 411 comes into contact with the entrance edge, forcefully moves over the edge by, for example, elastically deforming the components to some degree, and then enters the recessed portion 311. For this reason, a user closing the door 60 feels a certain awkwardness against his/her hand, such as a feeling that something has hit against something while closing the door 60. Thus, it is difficult for the user to feel smooth operability.

As described above, in the exemplary embodiment, a long hole is provided that has a major axis extending in the opening direction of the door 60 away from the center line of rotation of the door 60, and the long hole 422 is disposed in the long-hole restriction shaft 62. With the long hole 422 and the long-hole restriction shaft 62 disposed in the long hole 422 according to the exemplary embodiment, while the door 60 is being opened and closed, the guide member 43 is allowed to move along such a trajectory that the guide member 43 is prevented from coming into contact with the fixing device 50, and the bearing member 411 is allowed to move along such a trajectory that the bearing member 411 is prevented from interfering with the edge of the recessed portion 331. Accordingly, the structure according to the exemplary embodiment contributes to smooth operability of opening and closing the door and a reduction in the size of the apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a body frame;

a transport unit that transports a recording medium along a transport path in the body frame;

an image carrier on which a toner image is formed, the image carrier carrying the toner image and transporting the toner image to a transfer position through which the recording medium is to pass;

a transfer device that faces the image carrier at the transfer position, the transfer device nipping a recording medium passing through the transfer position together with the image carrier to transfer the toner image formed on the image carrier to the recording medium;

a fixing device that is disposed on a side that is further downstream than the transfer position in a direction in which the recording medium is transported, the fixing device fixing the toner image onto the recording medium to which the toner image has been transferred at the transfer position;

a guide member assembly including a guide member and a positioned portion, the guide member being positioned between the transfer device and the fixing device, the guide member guiding the recording medium to which the toner image has been transferred by the transfer device to the fixing device, the positioned portion being positioned at a position that is outside of a region through which the recording medium is to pass;

a door that includes a base plate and supports the guide member assembly on an inner side of the base plate, the door opening and closing with respect to the body frame by rotating around a center line of rotation thereof that extends substantially in a width direction that crosses a direction in which the recording medium passes; and a positioning member that is supported by the body frame and that positions the guide member by being pressed by the positioned portion, wherein the door further includes a support shaft and an urging member, the support shaft being fixed to the base plate and extending substantially parallel to the center line of rotation with a gap between the support shaft and the inner side of the base plate, the urging member urging the guide member assembly in such a direction that the guide member assembly is separated from the base plate, wherein the guide member assembly includes a support member supporting the guide member and having a side wall that extends in such a direction as to intersect a line drawn in the width direction and that has a hole through which the support shaft is inserted with some play being present, and the guide member assembly is supported by the door with some play being present between the guide member assembly and the base plate and is urged by the urging member, and wherein the hole is a long hole having a major axis extending in an opening direction of the door away from the center line of rotation of the door.

2. The image forming apparatus according to claim 1, wherein the center line of rotation of the door is positioned at an lower end portion of the door, wherein the image forming apparatus further comprises a receiving member that is fixed to the body frame and positioned so as to be closer to the center line of rotation of the door than the positioning member is, the receiving member being pressed by the support member when the door is rotated from an open state to a closed state, and wherein the long hole is formed at such a position and in such a shape that the support shaft disposed in the long hole is separated from the wall surface of the long hole when the door is in the closed state, the support shaft is brought into contact with a portion of the wall surface of the long hole that is lower than a topmost portion of the wall surface when the door starts being rotated from the closed state to the open state, and the support shaft is brought into contact with the topmost portion of the wall surface of the long hole when the door is rotated further to the open state and the support member is separated from the receiving member.

3. The image forming apparatus according to claim 2, wherein the fixing device is disposed at a position near a trajectory along which the guide member moves as the door is opened and closed, and wherein the long hole and the support shaft disposed in the long hole form a mechanism with which, when the door is opened and closed, the guide member is allowed to move along the trajectory along which the guide member is prevented from coming into contact with the fixing device.

4. The image forming apparatus according to claim 1, wherein the fixing device is disposed at a position near a trajectory along which the guide member moves as the door is opened and closed, and wherein the long hole and the support shaft disposed in the long hole form a mechanism with which, when the door is opened and closed, the guide member is allowed to move along the trajectory along which the guide member is prevented from coming into contact with the fixing device.

5. A transport guiding device comprising:

a body frame;

a transport unit that transports a transport object along a transport path in the body frame;

a guide member assembly including a guide member and a positioned portion, the guide member being positioned at a position along the transport path and guiding the transport object, the positioned portion being positioned at a position that is outside of a region through which the transport object is to pass;

a door that includes a base plate and supports the guide member assembly on an inner side of the base plate, the door opening and closing with respect to the body frame by rotating around a center line of rotation thereof that extends substantially in a width direction that crosses a direction in which the transport object passes; and a positioning member that is supported by the body frame and that positions the guide member by being pressed by the positioned portion, wherein the door further includes a support shaft and an urging member, the support shaft being fixed to the base plate and extending substantially parallel to the center line of rotation with a gap between the support shaft and the inner side of the base plate, the urging member urging the guide member assembly in such a direction that the guide member assembly is separated from the base plate, wherein the guide member assembly includes a support member supporting the guide member and having a side wall that extends in such a direction as to intersect a line drawn in the width direction and that has a hole through which the support shaft is inserted with some play being present, and the guide member assembly is supported by the door with some play being present between the guide member assembly and the base plate and is urged by the urging member, and wherein the hole is a long hole having a major axis extending in an opening direction of the door away from the center line of rotation of the door.

6. The transport guiding device according to claim 5, wherein the center line of rotation of the door is positioned at an lower end portion of the door, wherein the transport guiding device further comprises a receiving member that is fixed to the body frame and positioned so as to be closer to the center line of rotation of the door than the positioning member is, the receiving member being pressed by the support member when the door is rotated from an open state to a closed state, and wherein the long hole is formed at such a position and in such a shape that the support shaft disposed in the long hole is separated from the wall surface of the long hole when the door is in the closed state, the support shaft is brought into contact with a portion of the wall surface of the long hole that is lower than a topmost portion of the wall surface when the door starts being rotated from the closed state to the open state, and the support shaft is brought into contact with the topmost portion of the wall surface of the long hole when the door is rotated further to the open state and the support member is separated from the receiving member.

7. The transport guiding device according to claim 6, wherein the long hole and the support shaft disposed in the long hole form a mechanism with which, when the door is opened and closed, the guide member that moves as the door is opened and closed is caused to move along a trajectory along which the guide member is prevented from coming into contact with a member that is disposed at a position near the trajectory.

8. The transport guiding device according to claim 5, wherein the long hole and the support shaft disposed in the long hole form a mechanism with which, when the door is opened and closed, the guide member that moves as the door is opened and closed is caused to move along a trajectory along which the guide member is prevented from coming into contact with a member that is disposed at a position near the trajectory.

* * * * *